US005742874A

United States Patent [19]

Koshimura et al.

[11] Patent Number: 5,742,874

[45] Date of Patent: Apr. 21, 1998

[54] CHARGING DEVICE

[75] Inventors: Yasushi Koshimura; Kiyohari Nakagama; Atsushi Ogane; Mitsugu Nemoto, all of Hachioji, Japan

[73] Assignee: Konica Corporation, Japan

[21] Appl. No.: 760,844

[22] Filed: Dec. 5, 1996

[30] Foreign Application Priority Data

| | | | |
|---|---|---|---|
| Dec. 7, 1995 | [JP] | Japan | 7-319215 |
| Jan. 24, 1996 | [JP] | Japan | 8-009739 |
| Feb. 20, 1996 | [JP] | Japan | 8-032046 |

[51] Int. Cl.[6] ..... G03G 15/02

[52] U.S. Cl. ..... 399/100; 399/173

[58] Field of Search ..... 399/100, 98, 170, 399/173; 250/324–326; 361/212–214, 229–231

[56] References Cited

U.S. PATENT DOCUMENTS

| | | | |
|---|---|---|---|
| 3,396,308 | 8/1968 | Whitmore . | |
| 3,777,158 | 12/1973 | Kamogawa et al. | 250/324 |
| 3,936,184 | 2/1976 | Tanaka et al. | 399/93 |
| 4,050,802 | 9/1977 | Tanaka et al. | 399/93 |
| 4,466,813 | 8/1984 | Avritt et al. | 95/141 |
| 4,725,731 | 2/1988 | Lang . | |
| 4,725,732 | 2/1988 | Lang et al. . | |
| 4,745,282 | 5/1988 | Tagawa et al. | 250/326 |
| 5,170,211 | 12/1992 | Haupt et al. | 399/93 |
| 5,451,754 | 9/1995 | Reale | 250/324 |
| 5,457,521 | 10/1995 | Makiura et al. . | |
| 5,521,383 | 5/1996 | Furukawa et al. . | |
| 5,539,205 | 7/1996 | Reale | 250/326 |
| 5,655,187 | 8/1997 | Watanabe et al. | 399/171 X |
| 5,666,604 | 9/1997 | Nakagami et al. | 399/171 |

FOREIGN PATENT DOCUMENTS

| | | |
|---|---|---|
| 3314255 | 10/1983 | Germany . |
| 61-213868 | 9/1986 | Japan . |
| 61-213869 | 9/1986 | Japan . |
| 5-165302 | 7/1993 | Japan . |
| 7-064376 | 3/1995 | Japan . |
| 7-301977 | 11/1995 | Japan . |
| 7-311519 | 11/1995 | Japan . |

OTHER PUBLICATIONS

European Search Report EP 96 11 9414 and Annex EPO—Patent Abstracts of Japan Publication #61213870 Publication date Sep. 22, 1986–Abstract Only.

EPO—Patent Abstracts of Japan Publication #61235867 Publication date Oct. 21, 1986–Abstract Only.

*Primary Examiner*—Matthew S. Smith

*Attorney, Agent, or Firm*—Jordan B. Bierman Bierman, Muserlian and Lucas

[57] ABSTRACT

An charging apparatus includes a housing having a charging side adapted to face a photoreceptor; and a sharp-edged electrode charging member provided in the housing so that the photoreceptor is charged through the charging side by corona discharge from the sharp-edged electrode charging member. The charging apparatus further comprises an air introducing member provided a rear side opposite to the charging side and for introducing air into the housing.

18 Claims, 21 Drawing Sheets

COMPARATIVE EXAMPLE

COMPARATIVE EXAMPLE

INVENTIVE EXAMPLE

INVENTIVE EXAMPLE

CHARGING DEVICE

BACKGROUND OF THE INVENTION

The present invention relates to an image forming apparatus having a corona-discharge-type charging means wherein an edged electrode is employed.

Heretofore, a corona-discharge-type charging means used for the image forming apparatus such as a copying machine and a facsimile machine has generally been divided into a wire-charging-type and a pin-charging-type (such as a pin electrode type and an sharp edged electrode type). Recently, the latter type has come to be more used in electrophotographic copying machines and printers due to its small size and slow ozone emission. U.S. Pat. No. 4,725,732 discloses an edged electrode plate wherein plural edged electrodes, as discharging electrodes, were provided on one thin plate member. Japanese Patent Publication Open to Public Inspection No. 2314/1995 discloses a charging means having a structure in which edged-electrodes were used, edged electrodes and common electrode plates, which are independent each other, are provided on an individual body for attaining discharging stability and uniformity and a resistance substance is provided between specific edged electrodes and the common electrode plate.

However, in the above-mentioned methods, toner spattered from a cleaner, which is located upstream side in the movement direction of an image forming body from the charging means, and which is used for cleaning residual toner on the image forming body is drawn inside the charging means along with air on the circumference of the image forming body due to rotation of the image forming body and ion current which occurs due to corona discharge, causing contamination of the edged electrode.

As described above, those employing the edged electrodes as the charging means has merits; an apparatus is downsized, the emission of ozone is low and discharge from the edged electrodes is highly directive and stable discharge is resulted in. However, they also have the following shortcoming. Namely, since discharging is conducted along the edge portion of the edged electrode, the discharging portion is small as opposed conventional wire-discharging-type discharging electrodes. Therefore, once contamination occurs on the edged electrodes, white spots occurs on the resulting images. Specifically, in a high speed image forming apparatus, great discharging electrical current is necessary. Therefore, contamination on the edged electrodes easily occurs so that a problem of white spotting also easily occurs.

The present invention is an attempt to solve the above-mentioned problems, and to provide an image forming apparatus wherein contamination on the edged electrode provided on the charging means occurs with difficulty.

SUMMARY OF THE INVENTION

In order to solve the above-mentioned problems and to attain the objects of the present invention as well, the present invention is attained by a edged electrode device provided with an edged electrode mounted on an insulating board facing an image carrier in a shielding case, impressed with discharging voltage thereto and creating corona discharge, wherein an air introduction means which introduces air into the above-mentioned shielding case on the rear side, which is opposite to the discharging direction, in the shielding case enclosing the above-mentioned edged electrode. Due to the corona discharge by the edged electrode, air is introduced into the shielding case from the air introduction means which is located on the rear side, which is opposite to the discharging direction, in the shielding case. Due to aforesaid air current, adhesion of contaminant onto the edged electrode is minimized so that durability can be improved. In addition, since air is introduced into the shielding case from the air introduction means which is located on the rear side, which is opposite to the discharging direction, in the shielding case, contaminant on the edged electrode can be minimized due to the air current without interfering the movement of ozone current due to the corona discharge can be minimized.

Due to a structure that the above-mentioned has a pin-shaped or saw-toothed discharging tooth, contaminant on the edged electrode can easily be minimized with the air current so that durability can be improved.

Due to a structure that a slits for air current or a holes for air current functions the air introduction means, contaminant on the edged electrode can be minimized by air current due to a simple structure employing the shielding case.

Due to a structure that the width of the above-mentioned air introduction means is larger than the electrode width and/or the electrode length of the above-mentioned edged electrode, contaminant on the edged electrode can effectively be minimized due to the air current from the air introduction means.

Due to a structure that a dust-proof filter is mounted on the above-mentioned air introduction means, contaminant on the edged electrode can be minimized due to clean air.

The above-mentioned object is attained by an image forming apparatus, having a moving image forming body and plural edged electrodes whose direction is perpendicular to the movement direction of the above-mentioned image forming body, which forms toner images on the above-mentioned image forming body, wherein an inhalation port having a larger width compared to the width of the above-mentioned charging means is provided on a surface of the above-mentioned charging means opposite to the surface facing the above-mentioned image forming body.

The above-mentioned object is attained by an image forming apparatus, having a moving image forming body and plural edged electrodes whose direction is perpendicular to the movement direction of the above-mentioned image forming body, which forms toner images on the above-mentioned image forming body, wherein an air-inhalation fan which inhales air from an aperture provided on a surface opposite to the surface facing the above-mentioned image forming body in the above-mentioned charging means into the above-mentioned charging means is provided in the above-mentioned charging means.

The above-mentioned object is attained by an image forming apparatus, having a moving image forming body and plural edged electrodes whose direction is perpendicular to the movement direction of the above-mentioned image forming body, which forms toner images on the above-mentioned image forming body, wherein an air-exhaustion fan which expels air from an aperture provided on a surface opposite to an image forming body in the above-mentioned charging means from the above-mentioned charging means was provided in the above-mentioned charging means.

In addition, the above-mentioned object is attained by a corona charger, having a base and a metallic body composed of a side portion formed integrally facing aforesaid base, and which causes saw-toothed discharging points on the plate-shaped electrode provided on aforesaid metallic body to face the discharged body for discharging onto aforesaid discharged body, wherein plural aperture formed for inhaling air outside of the above-mentioned metallic body is provided at both side of upstream side and the downstream side respectively provided in the above-mentioned metallic body and, between aforesaid plural apertures, the span of the above-mentioned upstream side is larger than that of the downstream side.

It is preferable that the above-mentioned plural apertures are formed on the base of the above-mentioned metallic body, or that a reinforcing rib is formed on plural apertures formed on the base of the above-mentioned metallic body and that the number of reinforcing ribs formed on the above-mentioned downstream side aperture is larger than that formed on the above-mentioned upstream side aperture.

In addition, the above-mentioned object is attained by a corona charger, having a base and a metallic body composed of a side portion formed integrally facing aforesaid base, and which causes saw-toothed discharging points on the plate-shaped electrode provided on aforesaid metallic body to face the discharged body, wherein an aperture is formed for inhaling air outside from the above-mentioned metallic body on upstream side of the above-mentioned charging means and an air-exhaustion aperture formed on one of the end portion located on the upstream of the above-mentioned metallic body and one end of side portion positioning on the downstream side of the above-mentioned metallic body is brought into close with the surface of above-mentioned discharged body.

It is preferable that the aperture provided on the upstream side from the above-mentioned plate-shaped electrode is formed on the above-mentioned base of the metallic body, or that the exhaustion aperture provided on one end of the side portion of the above-mentioned metallic body is provided between the above-mentioned side portion and the above-mentioned discharged body.

In addition, the above-mentioned object is attained by a corona charger, having a base and a metallic body composed of a side portion formed integrally facing aforesaid base, and which causes saw-toothed discharging points on the plate-shaped electrode provided on aforesaid metallic body to face the discharged body for discharging onto aforesaid discharged body, wherein plural apertures formed for inhaling air outside from the above-mentioned metallic body and an exhaustion guide means in which an air-exhaustion aperture is formed on one end of the side plate positioning on the above-mentioned upstream side in the above-mentioned metallic body are provided on both ends, i.e., on the upstream side and the lower stream side, compared to the above-mentioned plate-shaped electrode provided in the above-mentioned metallic body and one end of the side portion positioning on the above-mentioned downstream in the above-mentioned metallic body is brought into close contact with the above-mentioned discharged body.

It is preferable that the above-mentioned plural apertures are formed on the base of the above-mentioned metallic body and the above-mentioned exhaustion guide means in which the exhaustion aperture is formed on the outside of the above-mentioned side portion and is formed between the above-mentioned side portion and the above-mentioned discharged body.

The above-mentioned object is attained by a corona charger, having a base and a metallic body composed of a side portion formed integrally facing aforesaid base, and which causes saw-toothed discharging points on the plate-shaped electrode provided on aforesaid metallic body to face the discharged body for discharging onto aforesaid discharged body, wherein plural apertures formed for inhaling air outside from the above-mentioned metallic body and an air-exhaustion aperture is formed on one end of the side plate positioning on the above-mentioned upstream side in the above-mentioned metallic body are provided on both ends, i.e., on the upstream side and the lower stream side, compared to the above-mentioned plate-shaped electrode provided in the above-mentioned metallic body and one end of the side portion positioning on the above-mentioned downstream in the above-mentioned metallic body is brought into close contact with the above-mentioned discharged body and an exhaustion guide means facing the above-mentioned upstream side is provided.

It is preferable that the above-mentioned plural apertures are formed on the base of the above-mentioned metallic body and the above-mentioned exhaustion aperture formed on the above-mentioned side portion is formed between the above-mentioned side portion and the above-mentioned discharged body.

The above-mentioned object is also attained by a corona charger, having a base and a metallic body composed of a side portion formed integrally facing aforesaid base, and which causes saw-toothed discharging points on the plate-shaped electrode provided on aforesaid metallic body to face the discharged body for discharging onto aforesaid discharged body, wherein plural apertures formed for inhaling air outside from the above-mentioned metallic body and an air-exhaustion aperture is formed on one end of the side plate positioning on the above-mentioned upstream side in the above-mentioned metallic body are provided on both ends, i.e., on the upstream side and the lower stream side, compared to the above-mentioned plate-shaped electrode provided in the above-mentioned metallic body and an elastic shielding member, which is provided on the side portion positioning on the above-mentioned downstream side of the above-mentioned metallic body, which is brought into contact with the above-mentioned discharged body was provided.

It is preferable that the above-mentioned plural apertures are formed on the above-mentioned base, exhaustion aperture formed on the above-mentioned side portion is formed between the above-mentioned side portion and the above-mentioned discharged body, or aforesaid exhaustion aperture is provided on the side portion positioning on the above-mentioned lower side of the above-mentioned metallic body and comprises an elastic shielding member brought into contact with the above-mentioned discharged body, both end aperture of the above-mentioned metallic body and brush-edged shielding members are provided between the side portion and the above-mentioned discharged body.

DETAILED DESCRIPTION OF THE PREFERRED EMBODIMENT

Hereinafter, an embodiment of the present invention will be explained. Incidentally, descriptions in the embodiment of the present invention do not limit the technological scope of the claims of the present invention or the meaning of its terms. In addition, decisive explanations in the present embodiment only show the best mode. However, they do not limit the meaning of terms in the present invention, or its technological scope.

When the present inventors conducted experiments on the flow of ion current which occurs in corona discharge by a charger used in an image forming apparatus, the following issues turned out.

Figure 1:
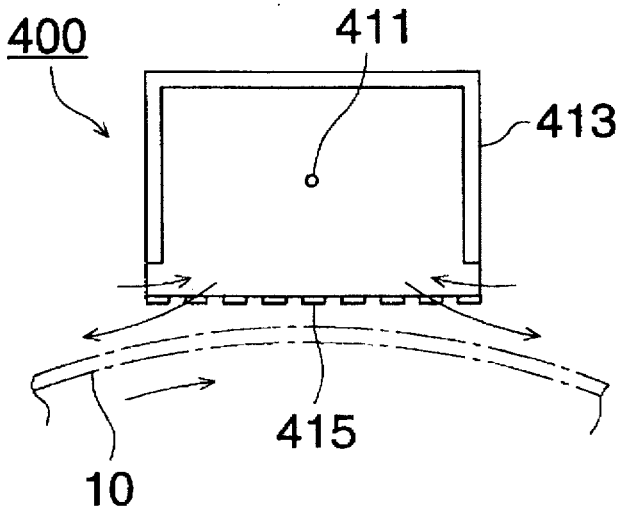
FIG. 1 PRIOR ART
FIG. 1 is a cross sectional view of the charging means employing a wire electrode.
Figure 2:
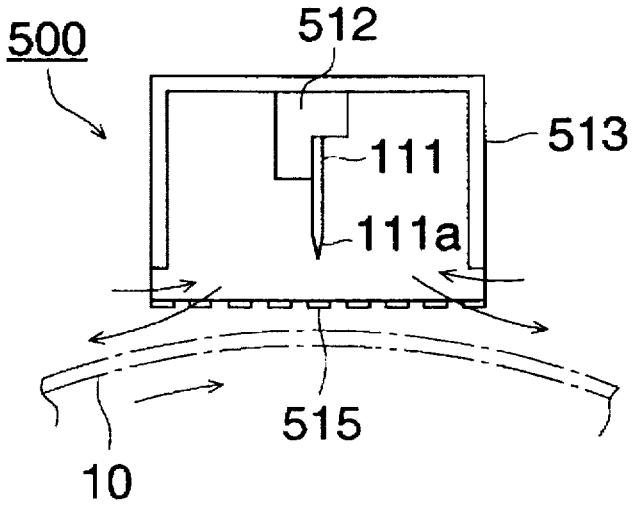
FIG. 2 PRIOR ART
FIG. 2 is a cross sectional view of the charging means employing an edged electrode.
Figure 3:
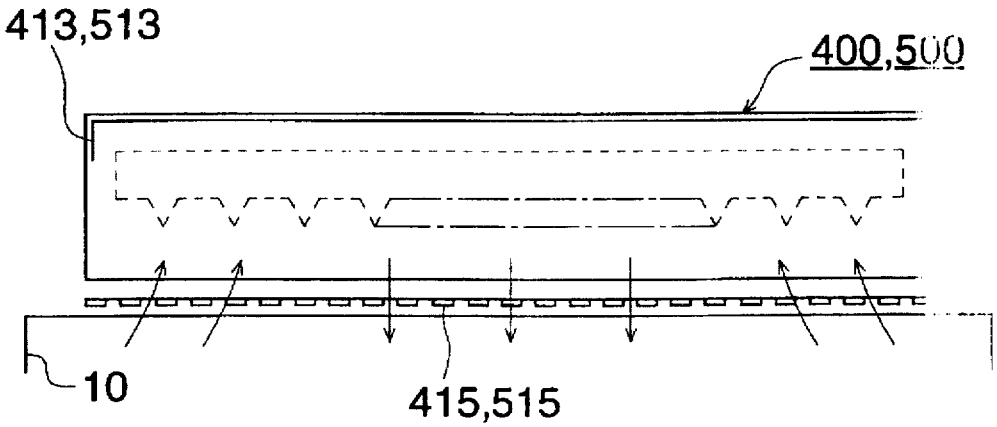
FIG. 3 PRIOR ART
FIG. 3 is a cross sectional view of the charging means in FIGS. 1 and 2.

Namely, FIG. 1 shows a cross sectional view of a charger employing a wire electrode. FIG. 2 shows a cross sectional view of the chargers employing an edged electrode. FIG. 3 shows a side elevation of a charger shown in FIGS. 1 and 2. Scorotron charger 400, as shown in FIG. 1, which employs wire electrode 411 as a charging electrode and which functions as a charger composed of side plate 413 as a channel shaped (⊃-shaped) shielding member not having an aperture on its rear surface and control grid 415 and scorotron charger 500, as shown in FIG. 2, which is mounted on supporting member 512, which employs edged electrode plate 111 and which is composed of side plate 513 as a shielding member not having an aperture on its rear surface and control grid 515 is mounted facing photoreceptor drum 10 which rotates in the arrowed direction in an image forming apparatus explained later. When corona discharge is conducted by wire electrode 411 and edged electrode 111*a*, due to ion current which is generated in corona discharge as shown in FIG. 3, while air exhaustion occurs at the center portion of the longitudinal direction of scorotron chargers 400 and 500 which face photoreceptor drum 10, air inhalation occurs at both ends. As shown in FIGS. 1 and 2, inside scorotron charger 400 and scorotron charger 500, air is drawn along photoreceptor drum 10 surface so that wire electrode 411 and edged electrode 111*a* become contaminated.

Figure 4:
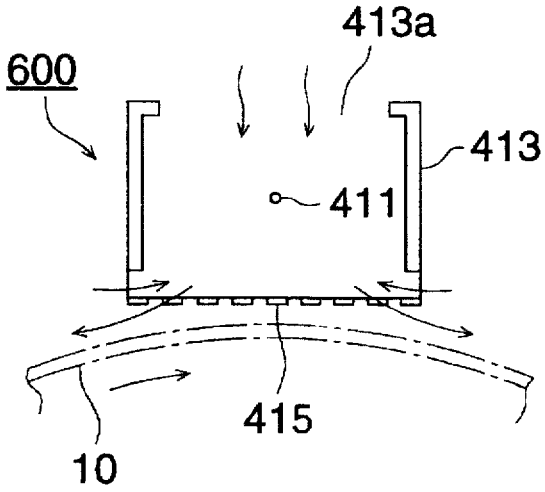
FIG. 4 is a drawing showing a charging means wherein an aperture is provided on the rear of the shielding member in FIG. 1.
Figure 5:
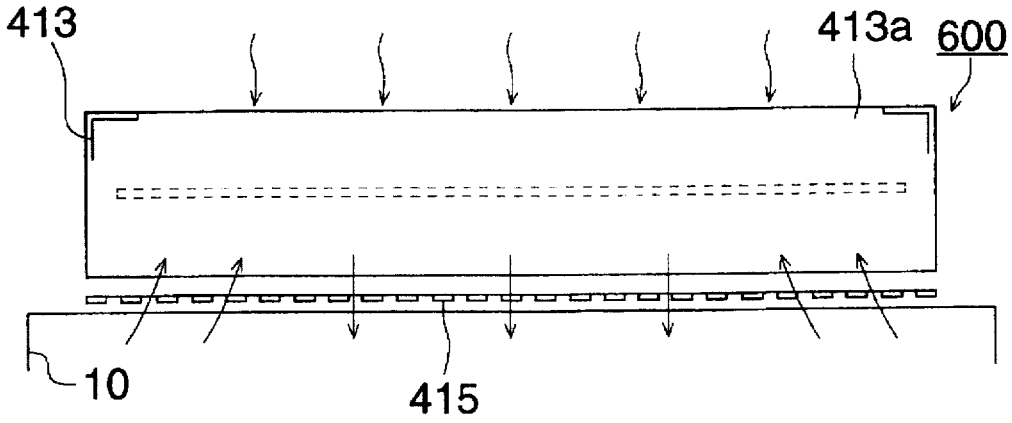
FIG. 5 is a cross sectional view of the charging means in FIG. 4.

In addition, FIG. 4 shows a charger provided with an aperture on the rear surface of the shielding member. FIG. 5 shows a side elevation of the charger. As shown in FIG. 4, scorotron charger 600 which uses wire electrode 411 as a discharging electrode and which is a charger composed of side plate 413 as a ⊃-shaped shielding member wherein aperture 413*a* was provided on the rear surface and control grid 415 was mounted facing photoreceptor drum 10 which is rotated in an arrowed direction onto the image forming apparatus. When corona discharge is conducted by wire electrode 411, due to ion current which generates in corona discharge as shown in FIG. 5, while air inhalation is conducted from aperture 413*a* on the rear surface and air exhaustion occurs at the center portion of the longitudinal direction of scorotron charger 600 which face photoreceptor drum 10, air inhalation occurs at both ends. As shown in FIG. 4, inside scorotron charger 600, air is drawn along photoreceptor drum 10 surface so that wire electrode 411 is contaminated.

Figure 6:
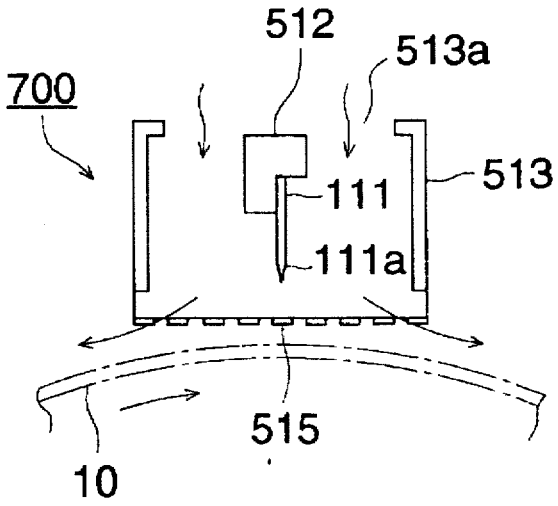
FIG. 6 is a drawing showing a charging means wherein an aperture is provided on the rear of the shielding member in FIG. 2.
Figure 7:
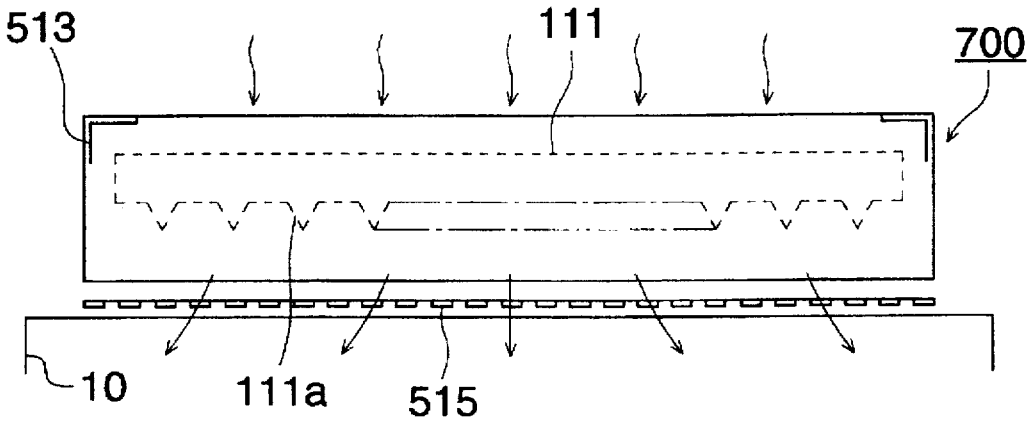
FIG. 7 is a cross sectional view of the charging means in FIG. 6.

However, FIG. 6 shows a charger provided with an aperture on the rear of the shielding member shown in FIG. 2. FIG. 7 shows a side elevation of the charger as shown in FIG. 6. As shown in FIG. 6, scorotron charger 700, which is mounted on supporting member 512, which employs edged electrode plate 111 provided with edged electrode 111*a* as a discharging electrode described in detail later and which is composed of side plate 513 as a ⊃-shaped shielding member having an aperture 513*a* on its rear surface and control grid 515 are mounted facing photoreceptor drum 10 which rotates in an arrowed direction in an image forming apparatus explained later. When corona discharge is conducted by edged electrode 111*a*, due to ion current which is generated along edged electrode 111*a* during corona discharge as shown by arrows in FIG. 7, it turned out that following phenomenon occurs; namely, air inhalation occurs from aperture 513*a* on the rear surface of longitudinal direction of scorotron charger 700 and air exhaustion occurs all over the surface facing photoreceptor drum 10.

An example of the air introduction means, which prevents contaminant of the edged electrode, conceived by the present inventors based on the above-mentioned experiment results will be explained.

Figure 8:
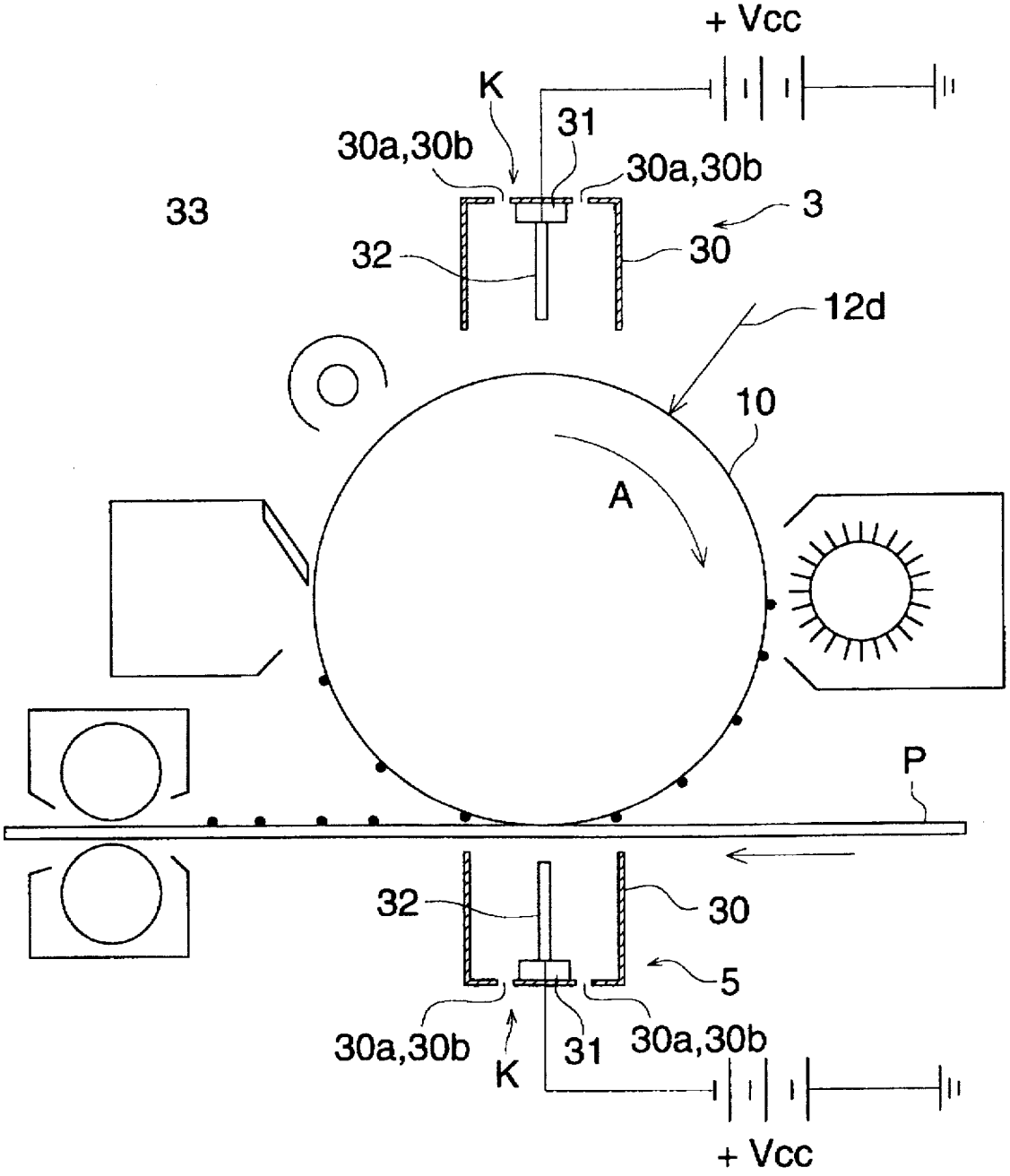
FIG. 8 is a schematic cross sectional view of an image forming apparatus.
Figure 9:
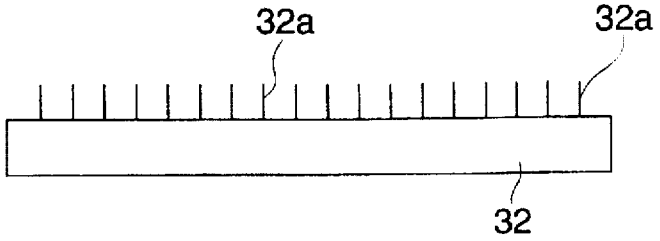
FIGS. 9*a* and 9*b* are cross sectional view of edged electrodes.
Figure 9:
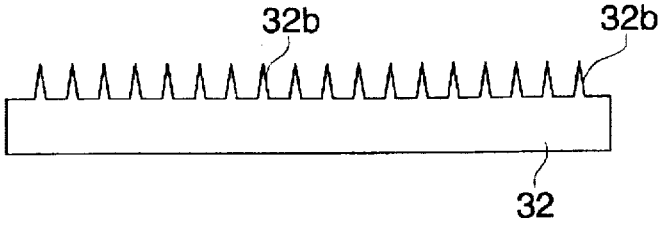

In FIG. 8, charger 3 is composed of ⊃-shaped (in terms of cross section) shielding case 30, insulating board 31 made of glass and epoxy and supported by inside of shielding case 30 and stainless steel-made edged electrode 32 mounted on insulating board 31 and connected to high voltage power supply +Vcc. Edged electrode 32 is provided with pin-shaped discharging tooth 32*a* as shown in FIG. 9(*a*) or saw-toothed shaped discharging tooth 32*b* as shown in FIG. 9(*b*). Charger 3 creates corona discharge from each of discharging tooth due to impressing high voltage onto edged electrode 32 from high voltage power supply +Vcc and thereby charges ambient surface of image carrier 10.

In the same manner as in charger 3, transfer charger 5 is composed of ⊐-shaped (in terms of cross section) shielding case 30, insulating board 31 made of glass and epoxy and supported by inside of shielding case 30 and stainless steel-made edged electrode 32 mounted on insulating board 31 and connected to high voltage power supply +Vcc. In the same manner as in charger 3, edged electrode 32 is provided with pin-shaped discharging tooth 32*a* as shown in FIG. 9(*a*) or saw-toothed shaped discharging tooth 32*b* as shown in FIG. 9(*b*). Transfer charger 5 creates corona discharge from each of discharging tooth due to impressing high voltage onto edged electrode 31 from high voltage power supply +Vcc and thereby charges the rear side of recording sheet P so that toner images formed on the ambient surface of image carrier 10 on recording sheet P.

Figure 10:
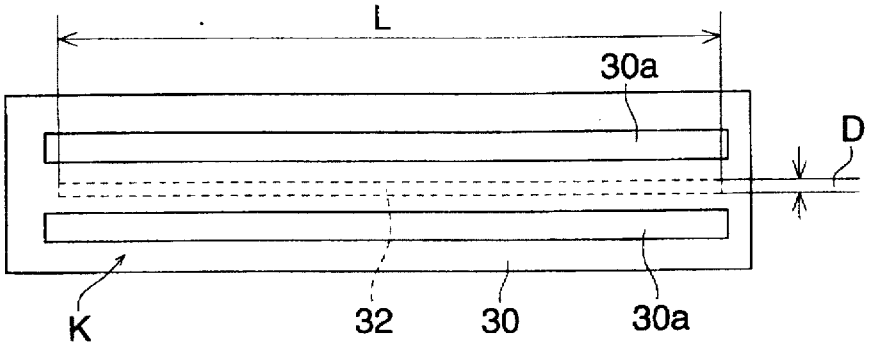
FIGS. 10*a* and 10*b* are plane view of edged electrodes.
Figure 10:
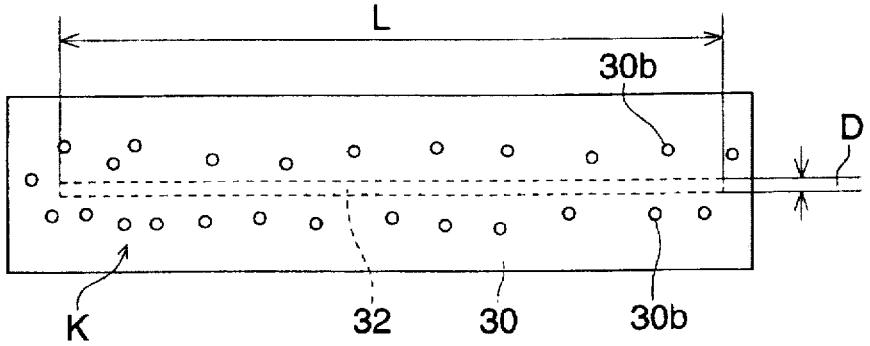

In shielding case 30 in charger 3 and transfer charger 5, on the rear opposite to the discharging direction, air introduction means K which introduces air inside shielding case 30 has provided. Air introduction means K Is slits 30*a* for air current as shown in FIG. 10*a*, or holes 30*b* for air current as shown in FIG. 30*b*. The width of slits 30*a* for air current or holes 30*b* for air current is in a range larger than the width D of electrode and/or length L of electrode of edged electrode 32. The size and form of slits 30*a* for air current or holes 30*b* for air current are arranged in such a manner that air exhausted from inside shielding case 30 due to corona discharge can sufficiently be supplemented.

Accordingly, due to the corona discharge by edged electrode 32, air is introduced into shielding case 30 through slits 30*a* for air current or holes 30*b* for air current which are air introduction means K formed on the rear of shielding case 30 opposite to the discharging direction. Due to aforesaid air current, contaminant on edged electrode 32 is minimized so that durability can be improved. In addition, since air is introduced into shielding case 30 through slits 30*a* for air current or holes 30*b* for air current which are air introduction means K formed on the rear of shielding case 30 opposite to the discharging direction, movement of ozone current due to corona discharge is not interfered by the air current so that contaminant on edged electrode 32 can be minimized due to the air current.

Contaminant of the edged electrode can be minimized due to air current with a simple structure wherein air introduction means K is either slits 30*a* for air current or holes 30*b* for air current and shielding case 30 is employed. In addition, the width of slits 30*a* for air current or holes 30*b* for air current is in a range larger than the width D of electrode and/or length L of electrode of edged electrode 32. Due to this, air current through slits 30*a* for air current or holes 30*b* for air current flows all over edged electrode 32 so that contaminant on edged electrode can effectively be minimized.

Figure 11:
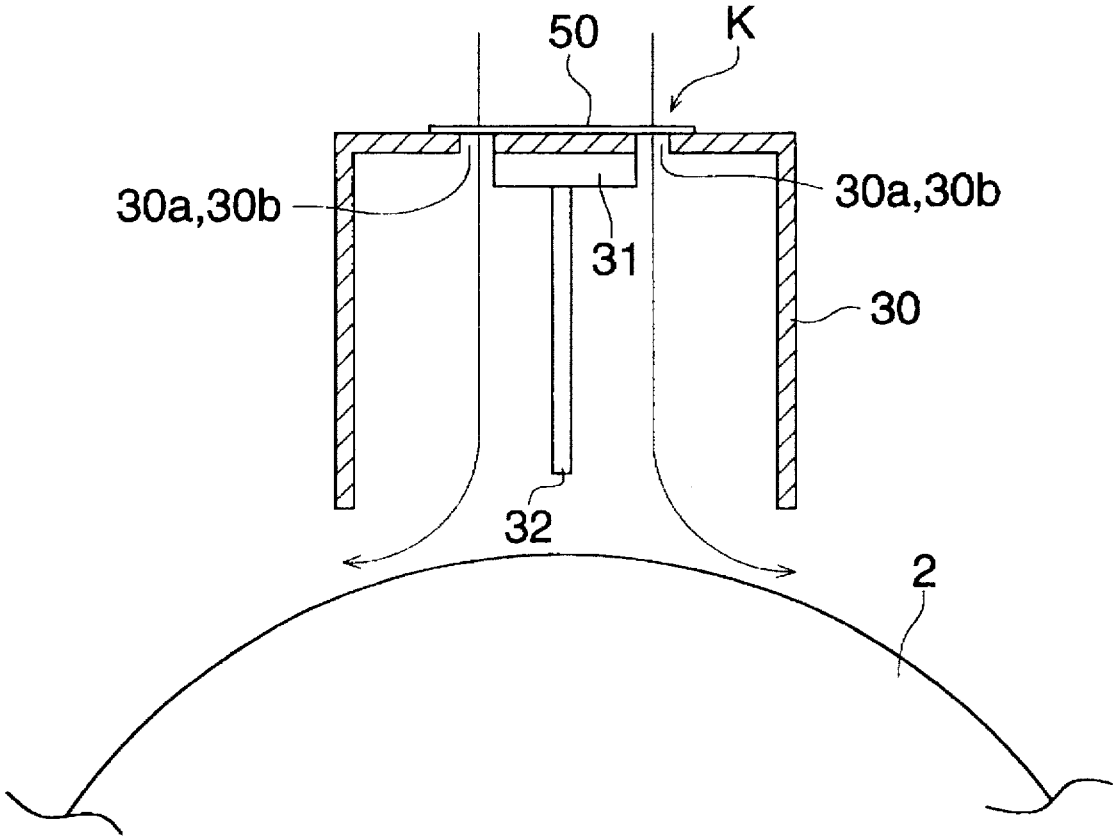
FIG. 11 is a cross sectional view of an edged electrode device in another example.

FIG. 11 is a cross section of another Example of edged electrode device. In the edged electrode device in this Example, dust-proof filter 50 is fixed outside shielding case 30 as if it covers shielding case 30. Aforesaid dust-proof filter 50 is mounted on slits 30*a* for air current or holes 30*b* for air current which are air introduction means K. By means of aforesaid dust-proof filter 50, air introduced to shielding case 30 is cleaned so that contaminant on edged electrode 32 can be minimized due to clean air current. Incidentally, dust-proof filter 50 may be fixed inside shielding case 30 as if it covers shielding case 30, and dust-proof filter 50 may be mounted on slits 30*a* for air current or holes 30*b* for air current.

Now, the second embodiment of the inventioned is explained.

Figure 13:
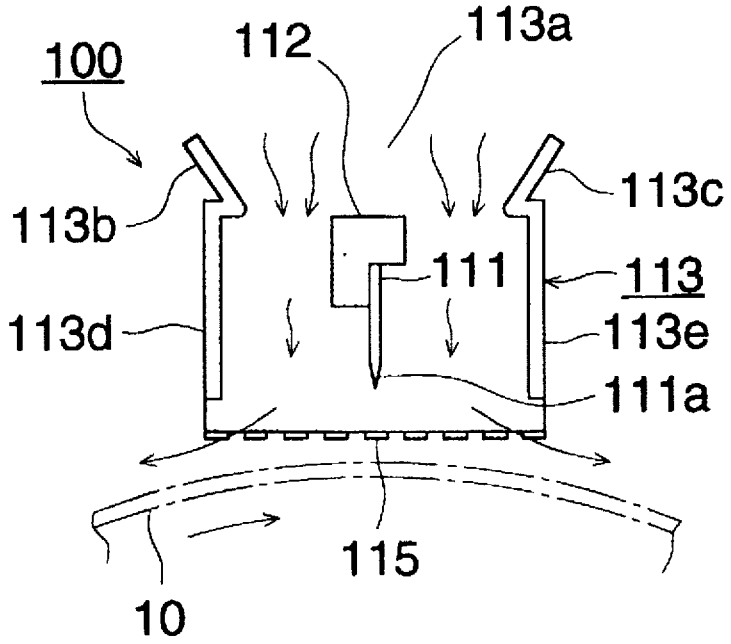
FIG. 13 is an enlarged drawing of a scorotron charger showing one embodiment of the charging means related to the first invention.

In FIG. 13, the shielding member explained in FIG. 6 was improved and as explained in detail later, a scorotron charger provided with reverse-trapezoid-shaped (V-shaped) bars 113*b* and 113*c* for providing aperture 113*a* as an inhalation port wherein the top span between 113*b* and 113*c* is greater than the width of scorotron charger 100, as a charger, which is defined by legs 113*d* and 113*e* of the side plate on rear surface of ⊐-shaped side plate 113 which is used as a shielding member is constituted.

Scorotron charger 100, as a charging means, is mounted facing photoreceptor drum 10 which is rotated in the arrowed direction to the image forming apparatus explained later. When corona discharge is conducted by edged electrode 111*a*, ion current having high directivity occurs toward the image forming body along edged electrode 111*a* due to corona discharge having high directivity. In order to decrease pressure reduction inside the scorotron charger due to the ion current, flowing in of air having less contamination is promoted from aperture 113*a* as inhalation port having larger span compared to the width of scorotron charger as a charging means into inside of the scorotron charger 100 through the rear surface of the charging means. Accordingly, inhalation of air from aperture 113*a* as an inhalation port on the rear surface in the longitudinal direction of scorotron charger 100 and exhaustion of air from scorotron charger 100 all along the facing photoreceptor drum 10 are further accelerated.

Figure 12:
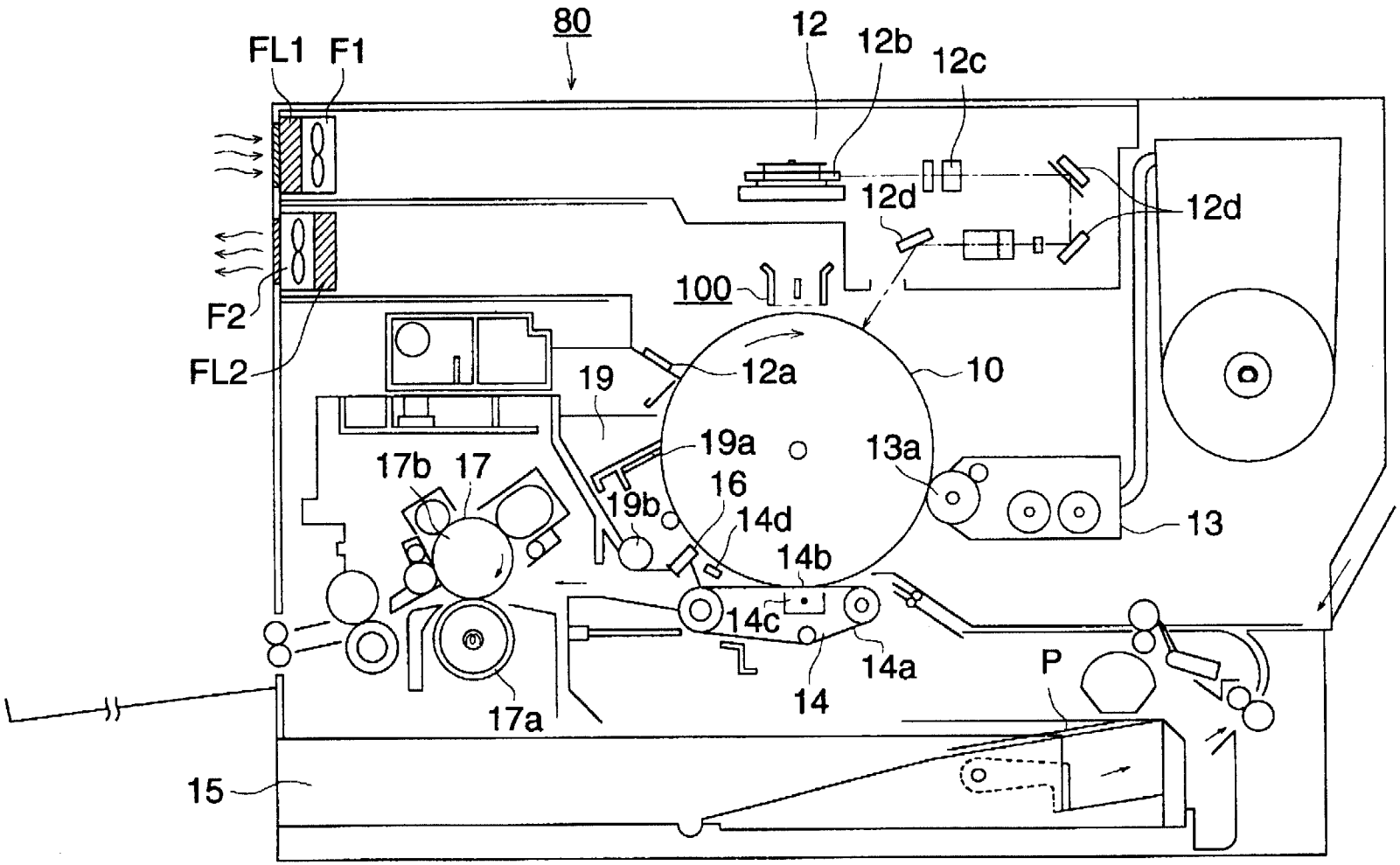
FIG. 12 is a cross sectional block diagram of laser printer 80 showing one embodiment of an image forming apparatus of the present invention.

Referring to FIG. 12, an image forming process and each mechanism of one embodiment of an image forming apparatus common in the present invention will now be explained. FIG. 12 is a cross sectional block diagram of laser printer 80 showing one embodiment of the image forming apparatus of the present invention.

Photoreceptor drum 10 as an image forming body is driven to be rotated in the arrowed direction in FIG. 12 at circumferential speed (line speed) of 150 mm/sec. In order to remove traces of the previous printing on photoreceptor drum 10, prior to charging, uniform exposure by a uniform exposure device such as emitting diode 12*a* is conducted so that circumference on the photoreceptor is neutralized so that charging of previous printing is removed.

The circumference of photoreceptor drum 10 is uniformly charged by scorotron charger 100, which is a charging means. Following this, the photoreceptor drum is subjected to image exposure based on image signals by image exposure means 12. Image exposure means 12 rotates laser beams emitted from the laser light source by polygonal mirror 12*b* for scanning, and through fθ lens 12*c* and reflective mirror 12*d*, latent images are formed on the photoreceptor drum.

On a side wall in the image forming apparatus, air-inhalation fan F1 and air-exit fan F2 are provided. By means of air-inhalation fan F1 provided in the image forming apparatus, air outside is purified through filter FL1 to be flowed in for chilling image exposure means 12. In addition, by air-exit fan F2 provided in the image forming apparatus, air in the apparatus containing ozone which occurred by a charging means and toner spattered from the cleaner and the developing device passes filter FL2 to be purified, and then is exited outside the apparatus.

Developing device 13, which is a developing means filled with a developer composed of toner and carrier, is provided. Development of latent image formed on photoreceptor drum 10 is conducted by developing sleeve 13*a*. A.C. bias and D.C. bias are superposed to be impressed between development sleeve 13*a* and photoreceptor drum 10 so that development is conducted in a form of non-contact reversal development.

Recording sheet P housed in transfer means housing container 15 is synchronized with toner image formed on photoreceptor drum 10, and is fed to nip portion (transfer region) 14*b* formed between photoreceptor drum 10 and transfer belt 14*a* by transfer belt device 14 wherein transfer belt 14*a* is bridged. By transfer means 14*c*, images on photoreceptor drum 10 are collectively transferred on recording sheet P. After the transfer operation, transfer belt 14*a* is separated from photoreceptor drum 10.

Recording sheet P separated from transfer belt device 14 by separating device 14*d* is conveyed to fixing device 17 having heating fixing roller 17*a* and pressure roller 17*b* having a heater inside at least one roller. By applying heat and pressure between heating fixing roller 17*a* and pressure roller 17*b*, toner adhered on recording sheet P is fixed, and then, exited outside the apparatus.

After being neutralized by neutralizer 16, toner, which remained on the circumference of photoreceptor drum 10 after transferring, reaches cleaner 19, where the toner is scraped into cleaner 19 by cleaning blade 19*a*, composed of rubber, which is brought into contact with photoreceptor drum 10, and then, is collected by an waste toner container (not illustrated) by screw 19*b*.

Photoreceptor drum 10, from which residual toner was removed by means of cleaner 19, is subjected to uniform exposure by emission diode 12*a*. Following this, the photoreceptor drum 10 is subjected to uniform charging by scorotron charger 100, and then, enters into the next image forming cycle. During image formation, cleaning blade 19*a* is kept separated from photoreceptor drum 10.

Figure 14:
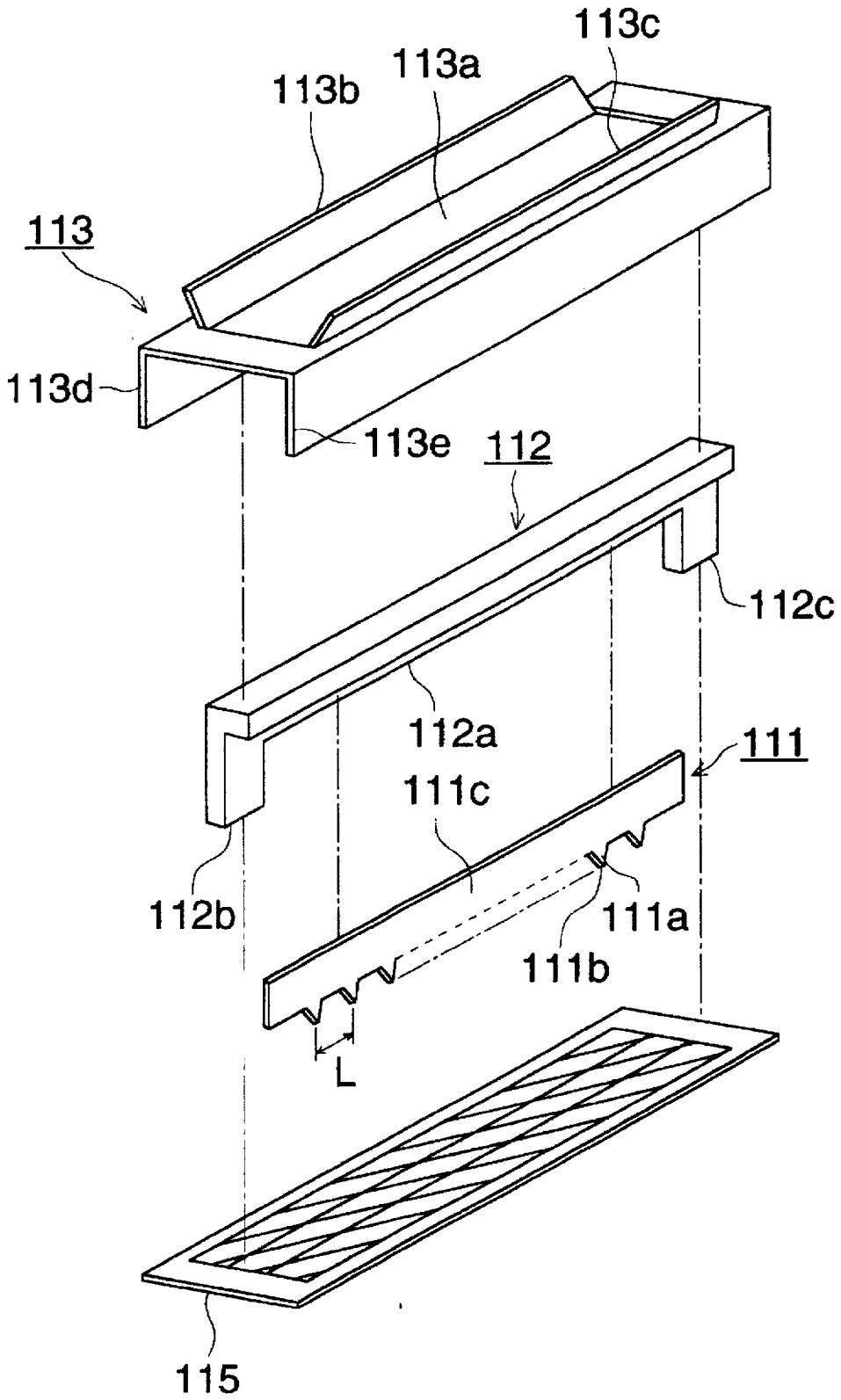
FIG. 14 is a drawing showing constitution members of the charging means in FIG. 13 and how to assemble them.

The second embodiment of the charging means of the present invention will now be explained referring to FIGS. 13 and 14. FIG. 13 is an enlarged view of a scorotron charger showing the second embodiment of the charging means. FIG. 14 is a drawing showing the composing members of the charging means shown in FIG. 13 and how to assemble them.

Edged electrode plate 111 is an electrode plate for corona discharge, wherein edged electrode 111*a*, which is a discharge electrode, such as a saw-toothed electrodes or bar-shaped electrodes, are provided with a certain pitch L on one side of bar-shaped plate 111*c* as plural discharging electrode, and located perpendicularly to the movement direction of photoreceptor drum 10 which is an image forming body.

Edged electrode plate 111 is an etched stainless steel plate having 0.1 mm thickness. The curvature of edged portion 111*b* in edged electrode 111*a* is R=40 μm or less.

Control grid is an etched stainless steel plate having. 0.1 mm thickness, and is a shielding member. ⊃-shaped side plate 113 is molded by a stainless steel plate. Aforesaid side plate is composed of ⊃-shaped legs 113*d* and 113*e* at both ends and ⋀-shaped legs 113*b* and 113*c* provided at the top of side plate 113 and in such a manner that aperture 113*a* is provided as a ⋀ shape so that span between 113*b* and 113*c* is larger than the width of scorotron charger 100 as a charging means determined by span between side plate legs 113*d* and 113*e*.

Edged electrode plate 111 is fixed with an adhesive agent to side surface 112*a* of supporting member 112 made of an insulating resin, for example, an ABS resin. Side plate 113 mounted on supporting member 112 parallel to longitudinal direction of edged electrode plate 111 with resin screws (not illustrated) for fixing and control grid 115 is mounted on surfaces 112*b* and 112*c* for mounting the control grids of supporting member 112 with resin screws (not illustrated) so that scorotron charger 100, which is a corona discharging means, is formed.

In an image forming apparatus as shown in FIG. 12, the above-mentioned scorotron charger 100 is amounted facing photoreceptor drum in such a manner that edged electrode 111*a* is arranged in a direction perpendicular to the movement direction of photoreceptor drum 10 as an image forming body as shown by arrows in FIG. 13, and when image is formed, photoreceptor drum 10 is charged wherein D.C. voltage, for example, −5—7 kVDC, is applied to edged electrode plate 111, D.C. voltage, for example, −600—900 kVDC, is applied to control grid 115 and D.C. voltage, for example, −500—900 kVDC, is applied to side plate 113 for corona discharge. In addition, clearance between legs 113*d* and 113*e* of side plate 113 and photoreceptor 10 is set to be 3–8 mm so that air inside scorotron charger is sufficiently discharged.

As shown by arrows in FIG. 13, when corona discharge is conducted, due to corona discharge having high directivity, ion current having high directivity occurs from edged electrode 111*a* toward the image forming body along edged electrode 111*a*. By pressure reduction inside the scorotron charger due to the ion current, flowing in of air having less contamination is promoted from aperture 113*a* as inhalation port having larger span compared to the width of scorotron charger as a charging means into inside of the scorotron charger 100 through the rear surface of the charging means. Accordingly, inhalation of air from aperture 113*a* as an inhalation port on the rear surface in the longitudinal direction of scorotron charger 100 and exhaustion of air from scorotron charger 100 all throughout facing photoreceptor drum 10 are further accelerated.

In the above-mentioned embodiment, it is not necessary that aperture legs 113*b* and 113*c* of side plate 113, as a shielding member, is necessarily molded integrally with side plate 113. They may be mounted on the side plate wherein another member is separately provided. The form of the side plate as the shielding member is not limited to being U-shaped. So long as air flow from the air intake at the back of the housing is permitted, it will lessen the reduction in air pressure which would otherwise occur due to the ion current generated by the corona discharge. In addition, the form of aperture leg which forms an air-inhalation port is not limited to the shape of guide plates 113*b* and 113*c* as shown in FIG. 13. Any shape is satisfactory if it allows generation of sufficient air flow from the intake to reduce the vacuum which the corona discharge would otherwise cause.

Figure 15:
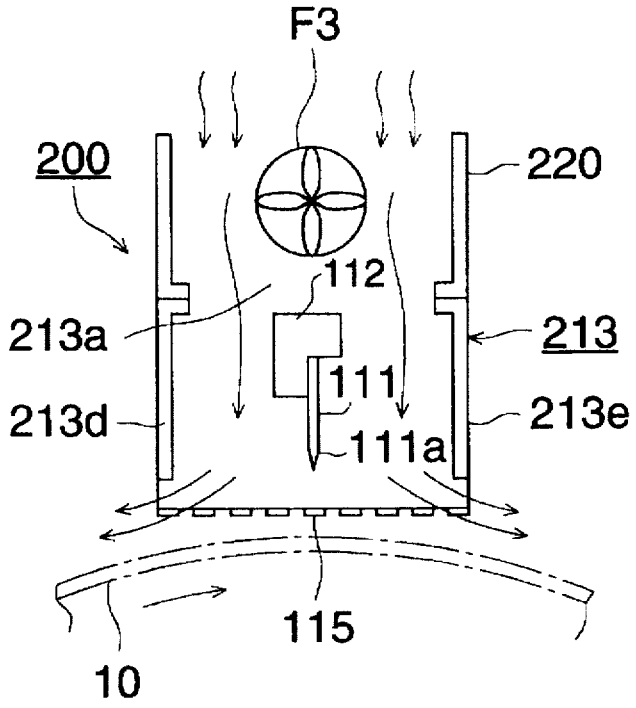
FIG. 15 is an enlarged drawing of a scorotron charger showing one embodiment of the charging means related to the second invention.

The third embodiment of the charging means of the present invention will now be explained referring to FIGS. 13 and 15. FIG. 15 is an enlarged drawing of a scorotron charger showing the third embodiment of the charging means of the present invention. The assembly method of the third embodiment is the same as that explained in the second embodiment referring to FIG. 13. Identical numerals were applied to those having the same function and the same structure as in the above-mentioned first embodiment.

Edged electrode plate 111, composed of edged electrode 111*a* provided on one end of band-shaped plate 111*c* as plural discharging electrodes, is an electrode plate for corona discharge perpendicular to the movement direction of the photoreceptor drum 10 which is an image forming body wherein saw-toothed electrodes or bar-shaped electrodes are provided at a certain pitch L.

Edged electrode plate 111 is an etched stainless steel plate having 0.1 mm thickness, and the curvature of edge portion 111*b* of edged electrode 111*a* is R=40 μm or less.

Control grid 115 is an etched stainless steel plate having 0.1 mm thickness, and is used as a shielding member. ⊐-shaped side plate 213 is molded of a stainless steel plate. It is composed of ⊐-shaped legs 213*d* and 213*e* at both ends and aperture 213*a* is provided on the rear surface of side plate 213 as shown in FIGS. 13 and 14.

Edged electrode plate 111 is fixed with an adhesive agent to side surface 112*a* of supporting member 112 made of an insulating resin, for example, an ABS resin. Side plate 113 mounted on supporting member 112 parallel to longitudinal direction of edged electrode plate 111 with resin screws (not illustrated) for fixing and control grid 115 is mounted on surfaces 112*b* and 112*c* for mounting the control grids of supporting member 112 with resin screws (not illustrated) and, above aperture 213*a* on the rear of side plate 213, casing 220 wherein inhalation fan F3, for example, a sirocco fan or a propeller fan is provided is mounted so that scorotron charger 100, which is a corona discharging means, is formed.

In an image forming apparatus as shown in FIG. 12, the above-mentioned scorotron charger 200 is mounted facing photoreceptor drum in such a manner that edged electrode 111*a* is arranged in a direction perpendicular to the movement direction of photoreceptor drum 10 as an image forming body as shown by arrows in FIG. 15, and when an image is formed, photoreceptor drum 10 is charged wherein D.C. voltage, for example, −5 to −7 kVDC, is applied to edged electrode plate 111, D.C. voltage, for example, −600 to −900 kVDC, is applied to control grid 115 and D.C. voltage, for example, −500 to −900 kVDC, is applied to side plate 213 for corona discharge. In addition, clearance between legs of side plate 213 and photoreceptor 10 is set to be 3–8 mm so that air inside scorotron charger 200 is sufficiently discharged. During operation of scorotron charger 200 by which corona discharge is conducted, inhalation fan F3 is rotated. Through aperture 213*a*, air is fed into scorotron charger 200.

As shown by arrows shown in FIG. 15, due to operation of inhalation fan, purified air is fed from the aperture portion of the top of the charging means into the image forming body. Due to exhaustion of air from the edged electrode to the image forming body, entrance of toner spattered from the cleaner into the charging means can be prevented so that contamination of the edged electrode is prevented.

In the above-mentioned embodiment, the form of the side plate as the shielding member is not limited to ⊐-shaped. It may be U-shaped or trapezoid-shaped. In addition, the casing may be formed integrally with the side plate as the shielding member. In addition, while inhalation fan F3 is not provided, as shown in FIG. 12, inhalation fan F1 is used in combination as if it were an optical cooler, air channel from inhalation fan F1 to the charging means is formed so that air may be fed to the charging means.

Figure 16:
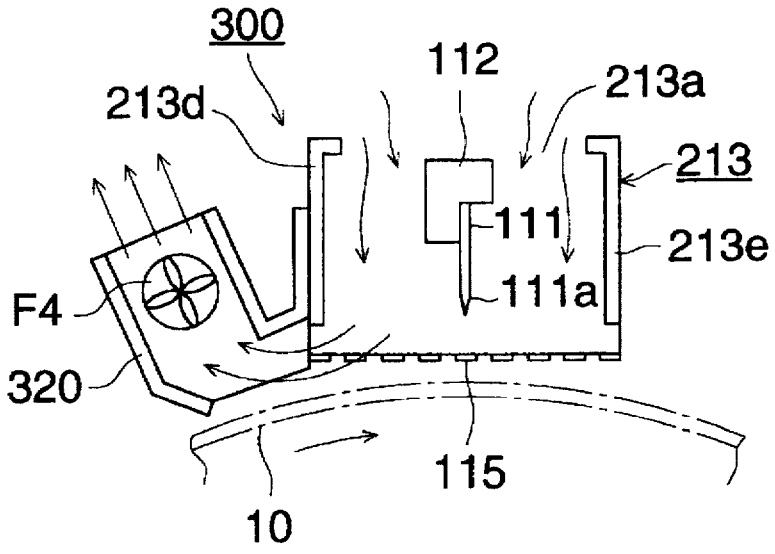
FIG. 16 is an enlarged drawing of a scorotron charger showing one embodiment of the charging means related to the third invention.

The fourth embodiment of the charging means of the present invention will now be explained referring to FIGS. 13 and 16. FIG. 16 is an enlarged drawing of a scorotron charger showing the fourth embodiment of the charging means of the present invention. The assembly method of the fourth embodiment is the same as that explained in the second embodiment referring to FIG. 13. Identical numerals were applied to those having the same function and the same structure as in the above-mentioned second and third embodiments.

Edged electrode plate 111 is an etched stainless steel plate having 0.1 mm thickness, and the curvature of edge portion 111*b* of edged electrode 111*a* is R=40 μm or less.

The control grid is an etched stainless steel plate having 0.1 mm thickness, and serves as a shielding member. The ⊐ shaped side plate 213 is molded by a stainless steel plate. It is composed of ⊐-shaped legs 213*d* and 213*e* at both ends and aperture 213*a* is provided on the rear surface of side plate 213.

Edged electrode plate 111 is fixed with an adhesive agent to side surface 112*a* of supporting member 112 made of insulating resin, for example, an ABS resin. Side plate 213 mounted on supporting member 112 parallel to longitudinal direction of edged electrode plate 111 with resin screws (not illustrated) for fixing and control grid 115 is mounted on surfaces 112*b* and 112*c* for mounting the control grids of supporting member 112 with resin screws (not illustrated) and, at external side surface of at least either of legs 213*d* and 213*e* of side plate 213, casing 320 wherein inhalation fan F4, for example, a sirocco fan or a propeller fan is provided is mounted so that scorotron charger 300, which is a corona discharging means, is formed.

In an image forming apparatus as shown in FIG. 12, the above-mentioned scorotron charger 300 is amounted facing photoreceptor drum in such a manner that edged electrode 111*a* is arranged in a direction perpendicular to the movement direction of photoreceptor drum 10 as an image forming body as shown by arrows in FIG. 16, and when an image is formed, photoreceptor drum 10 is charged wherein D.C. voltage, for example, −5 to −7 kVDC, is applied to edged electrode plate 111, D.C. voltage, for example, −600 to −900 kVDC, is applied to control grid 115 and D.C. voltage, for example, −500 to −900 kVDC, is applied to side plate 213 for corona discharge. In addition, clearance between legs of side plate 213 and photoreceptor 10 is set to be 3–8 mm so that air inside scorotron charger 300 is sufficiently discharged. During operation of scorotron charger 300 by which corona discharge is conducted, inhalation fan F3 is rotated. Through aperture 213*a*, air is fed into scorotron charger 300.

As shown by arrows shown in FIG. 16, due to operation of exhaustion fan, exhaustion of air inside the charging means is compulsorily conducted so that inside the charging means is caused to be evacuated. Due to this, inhalation of air having little contamination from the rear to the charging means is facilitated so that entrance of toner spattered from the cleaner into the charging means can be prevented, resulting in contamination of the edged electrode is prevented.

In the above-mentioned embodiment, the form of the side plate as the shielding member is not limited to ⊐-shaped. It may also be U-shaped or trapezoid-shaped. In addition, the casing may be formed integrally with the side plate as the shielding member. In addition, while exhaustion fan F4 is not provided, as shown in FIG. 12, exhaustion fan F2 for removing ozone is used in combination, air channel from inhalation fan F2 to the charging means is formed so that air may be fed to the charging means.

According to the second embodiment, in order to decrease pressure reduction inside the charging means, caused by highly directive ion current from the edged electrode to the image forming body by the edged electrode in corona discharge, inhalation of air having less contamination from the inhalation port of the rear of the charging means into inside the charging means is accelerated. In addition, due to exhaustion of air from the edged electrode to the image forming body direction, entrance of toner spattered due to the cleaner into inside the charging means is prevented so that contamination of the edged electrode is prevented.

According to the third embodiment, inhalation of purified air from the rear of the charging means into inside the charging means is accelerated. In addition, due to exhaustion of air from the edged electrode to the image forming body direction, entrance of toner spattered due to the cleaner into inside the charging means is prevented so that contamination of the edged electrode is prevented.

An air-inhalation fan provided in the image forming apparatus can be used in combination so that inhalation of exterior purified air can be attempted.

According to the fourth embodiment, exhaustion of air inside the charging means is compulsorily conducted by the air-exhaustion fan so that inside the charging means is caused to be evacuated. Due to this, inhalation of purified air from the rear to the charging means is facilitated so that entrance of toner spattered from the cleaner into the charging means can be prevented, resulting in neglibible contamination of the edged electrode.

An air-inhalation fan provided in the image forming apparatus can be used in combination.

Further, inhalation of air having less contamination from the rear of the charging means is accelerated.

Figure 17:
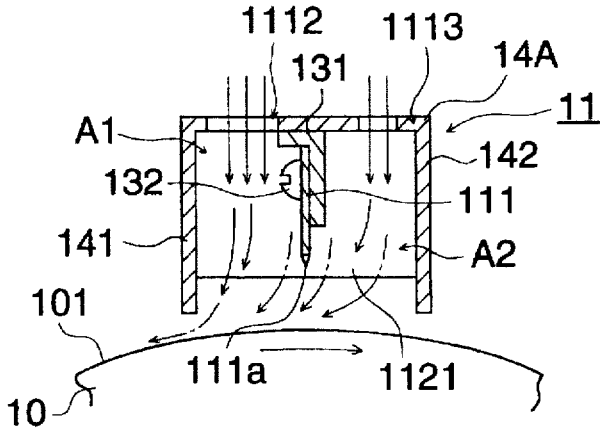
FIG. 17 is a side cross sectional view of a corona charger.

FIG. 17 shows a side cross sectional view showing fifth practical embodiment of corona charger 11 of the present invention.

In FIG. 17, plate-shaped electrode 111 which charges the above-mentioned photoreceptor 101 wherein saw-toothed-shaped discharging points 111*a* is housed is composed of stainless steel plate having 0.1 mm thickness. Aforesaid plate-shaped electrode 111 is processed with etching, and forms numerous saw-toothed-shaped discharging points 111*a* on the side fringe facing image region on photoreceptor 101 on photoreceptor drum 10, which is a discharged body, and is installed facing with a prescribed clearance with the surface of photoreceptor 101.

In addition, shielding case 14 of corona charger 11 is composed of shielding case base 14A and side portions 141 and 142 formed integrally with aforesaid shielding case base 14A, forming metallic frame with channel-shaped cross section. Inside the above-mentioned shielding case base 14A, at approximately the center thereof, one end of supporting member 131 composed of L-shaped insulating material is fixed. As the fixing method, an adhesive material is used. At a part of supporting member 131, the above-mentioned plate-shaped electrode 111 is fixed at a prescribed position with supporting screw 132, and the above-mentioned saw-toothed-shaped discharging points 111*a* is fixed at an adjusted and prescribed position. Due to structuring above, spaces A1 and A2 are separately formed inside side portions 141 and 142 formed integrally with the above-mentioned shielding case base 14A.

Space A1 is located at the initial charging side, i.e., upstream side of corona charger counter to the rotation direction of photoreceptor 101. Space A2 is located at the latter charging side, i.e., downstream side of corona charger counter to the rotation direction of photoreceptor 101. Namely, the upstream side is referred to as space A1, and the downstream side is referred to as space A2.

The above-mentioned shielding case base 14A, corresponding to the above-mentioned space A1, is provided with slit 1112. The above-mentioned shielding case base 14A, corresponding to the above-mentioned space A2, is provided with slit 1113.

Figure 19:
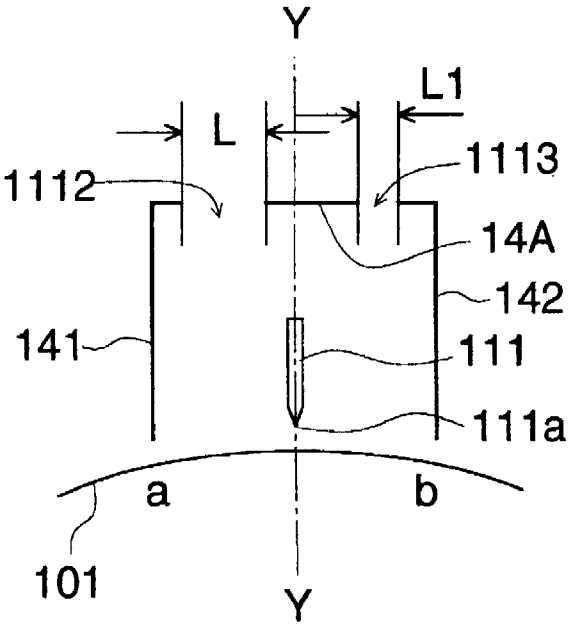
FIGS. 19(*a*) to 19(*c*) are explanation drawings showing the width of the aperture of the shielding case in the corona charger and its charging effects.
Figure 19:
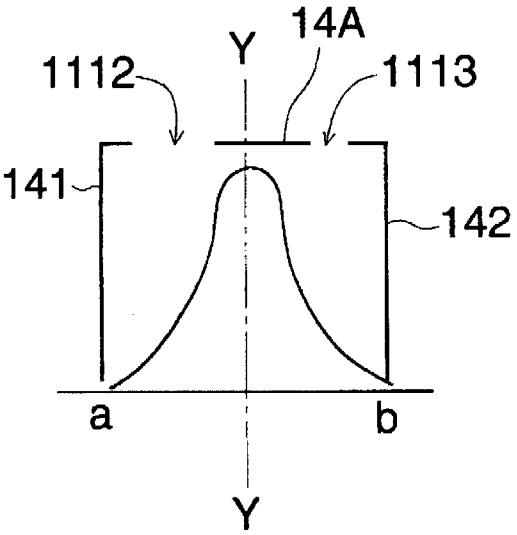
Figure 19:
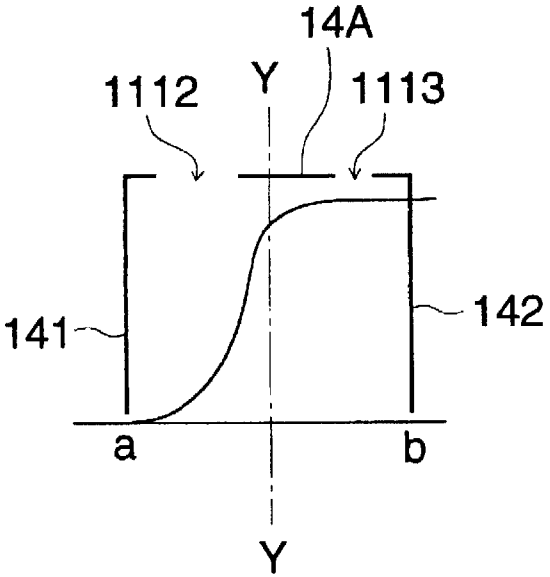

As shown in FIGS. 19(*a*), 19(*b*) and 19(*c*), effects of the embodiments of the present invention will be explained. As shown in FIG. 19(*a*), with saw-toothed-shaped discharging points 111*a* formed on the above-mentioned plate-shaped electrode 111 as the center, slit 1112 on the above-mentioned space A1 has its width L, and slit 1113 has its width L1. The relationship between the above-mentioned L and L1 is L>L1. In addition, as shown in FIG. 19(*a*), the contact of side portions 141 and 142 integrally formed with the above-mentioned shielding case base 14A and photoreceptor 101 is respectively defined to be "a" and "b". FIG. 19(*b*) shows discharging distribution when saw-toothed-shaped discharging points 12 formed on the above-mentioned plate-shaped electrode 111 conducted corona discharge. Namely, when the position of saw-toothed discharging points 111*a* is set to be on line Y—Y, the discharging distribution of saw-toothed discharging points 111*a* position on line Y—Y is the highest, and the positions "a" and "b", on the above-mentioned photoreceptor 101, which is positioned at the ends of side portions 141 and 142 is the lowest. FIG. 19(*c*) shows the amount of potential on photoreceptor 101 when corona discharge is conducted by the above-mentioned saw-toothed-shaped discharging points 111*a*. At the position "a" corresponding to side portion 141, as shown in FIG. 19(*c*), the amount of potential is approximately zero. Together with coming into contact with the line Y—Y wherein the above-mentioned saw-toothed-shaped discharging points 111*a* is positioned, the amount of potential increases. At the position "b" corresponding to side portion 142, the potential becomes maximum. In order that photoreceptor drum 101 becomes the maximum potential amount, the photoreceptor passes the line Y—Y and the maximum potential amount is for the first time attained at space A2. Accordingly, if the flow of air is poor, uneven charging performance occurs. Therefore, by arranging the relationship between the width L of slit 1112 and the width L1 of slit 1113 respectively on the above-mentioned shielding case base 14A L>L1, uniform air can be obtained.

As shown in FIG. 17, the width of slit 1112 formed on shielding case base 14A is larger than that of slit 1113. Accordingly, when discharging starts from the above-mentioned saw-toothed-shaped discharging points 111*a* to photoreceptor 101, as shown by continuous lines, exterior air is drawn through the above-mentioned slit 1112 from an ion current, as shown by dashed lines, which occurs by aforesaid discharging, assisting the occurrence of the ion current. Accordingly, a prescribed potential can be provided on photoreceptor surface 101 in space A1. In addition, due to discharging from the above-mentioned saw-toothed-shaped discharging points 111*a*, potential is provided on the surface of photoreceptor 101. Next, through slit 1113, exterior air shown by continuous lines enter to space A2. Since the width of aforesaid slit 1113 is slightly smaller than that of the above-mentioned slit 1112. Therefore, as shown by dashed lines, the occurrence of the ion current is slightly inferior. However, the amount of charge has been provided due to charging in space A1. Accordingly, a prescribed charge is stably provided during photoreceptor 101 passes corona charger 11.

Figure 18:
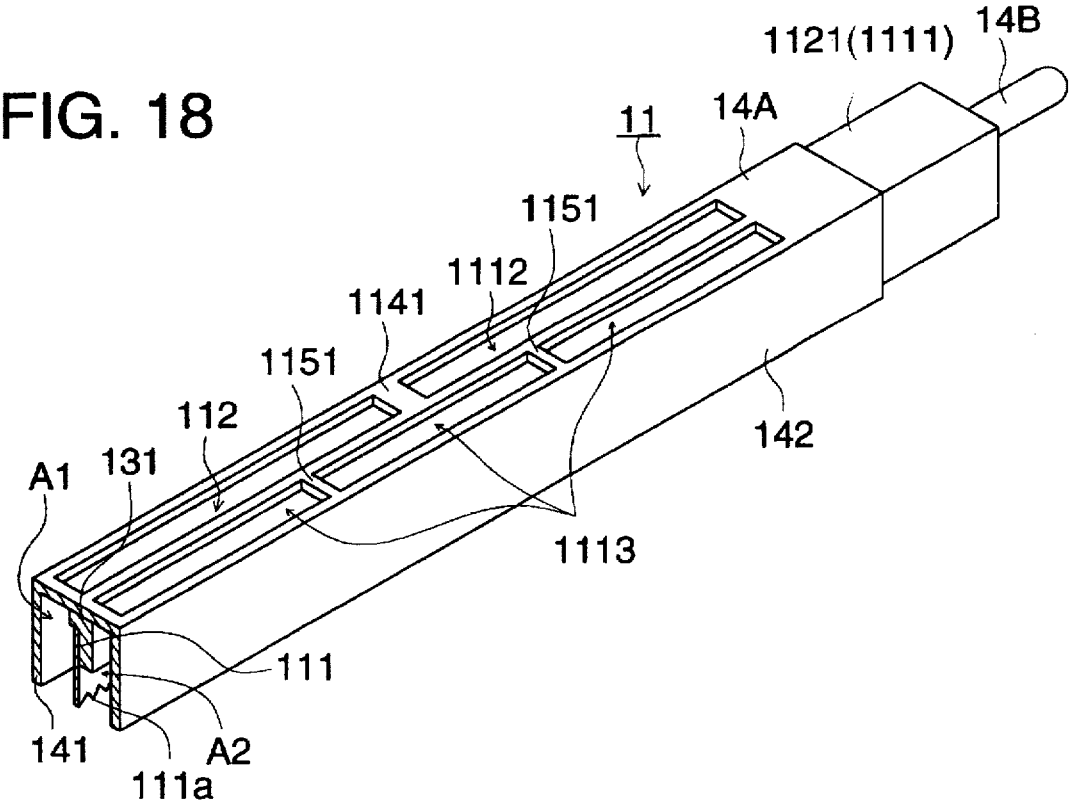
FIG. 18 is a perspective view showing the corona charger shown in FIG. 17.

FIG. 18 is a perspective view of corona charger 11 as shown in FIG. 17 wherein a part thereof is cut off. Specifically, it shows another constitution for modifying entrance of air through slits 1112 and 1113 formed on the above-mentioned shielding case base. As shown in FIG. 18, one reinforcing rib 1141 is formed to slit 1112, and two reinforcing ribs 1151 are formed to slit 1113. As shown above, by changing the number of reinforcing ribs 1141 and 1151, the amount of air invading through slits 1112 and 1113 can be changed. Side portions 141 and 142 integrally formed with shielding case base 14A is fixed to be supported to insulating shielding base supporting members 1111 (1121). On shielding case supporting member 1121, connection terminal 14B is provided so that the above-mentioned plate-shaped electrode 111 is connected to high voltage section.

Figure 20:
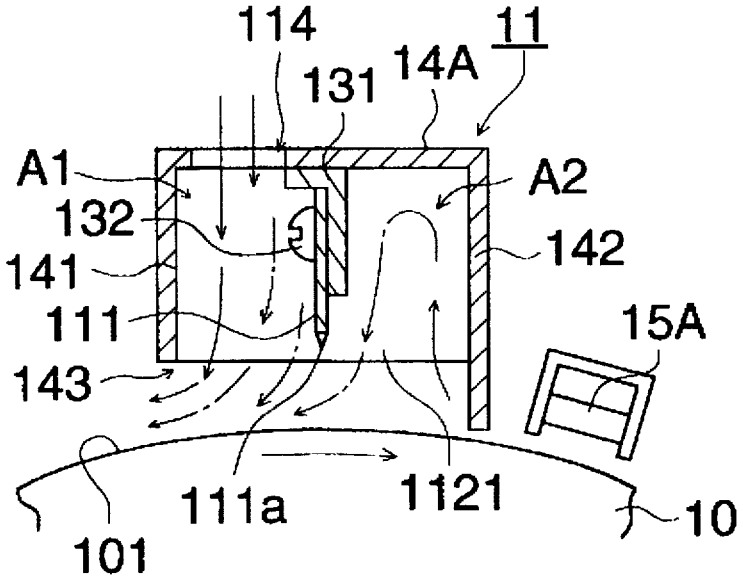
FIG. 20 is a side cross sectional showing another corona charger of the present invention.

Next, the sixth embodiment of corona charger 11 of the present invention will be shown in FIG. 20.

In the same manner as in FIG. 17, plate-shaped electrode 111 which charges the above-mentioned photoreceptor 101 wherein saw-toothed-shaped discharging points 111*a* is formed is composed of stainless steel plate having 0.1 mm thickness. Aforesaid plate-shaped electrode 111 is processed with etching, and forms numerous saw-toothed-shaped discharging points 111*a* on the side fringe facing image region on photoreceptor 101 on photoreceptor 10, which is a discharged body, and is installed facing with a prescribed clearance with the surface of photoreceptor 101.

In addition, shielding case 14 of corona charger 11 is composed of shielding case base 14A and side portions 141 and 142 formed integrally with aforesaid shielding case base 14A, forming metallic frame with channel-shaped cross section. Inside the above-mentioned shielding case base 14A, at approximately the center thereof, one end of supporting member 131 composed of L-shaped insulating material is fixed. As the fixing method, an adhesive material is used. At a part of supporting member 131, the above-mentioned plate-shaped electrode 111 is fixed at a prescribed position with supporting screw 132, and the above-mentioned saw-toothed-shaped discharging points 111*a* is fixed at an adjusted and prescribed position. In addition, between the end of side portion 141 and photoreceptor surface 101, air-exhaustion aperture 143 is formed. Due to structuring above, spaces A1 and A2 are separately formed inside side portions 141 and 142 formed integrally with the above-mentioned shielding case base 14A, and concurrently with this, on the above-mentioned shield case base 14A corresponding to aforesaid space portion A1, slit 114 is formed. Numeral 15A is the above-mentioned CEL (excess charge neutralizer), which is located at an external position of side portion 142, facing photoreceptor 101 closely.

When discharging starts from the above-mentioned saw-toothed-shaped discharging points 111*a* to photoreceptor 101, as shown by continuous lines, exterior air is drawn through the above-mentioned slit 114 from an ion current, as shown by dashed line, which occurs by aforesaid discharging, assisting the occurrence of the ion current. Further, since the ion current is exhausted from air-exhaustion aperture 143 formed on side portion 141 together with the above-mentioned external air, photoreceptor 101 surface is surely provided with a prescribed potential in space A1. Further, due to discharging from the above-mentioned saw-toothed-shaped discharging points 111*a*, potential is provided on the surface of photoreceptor 101. In addition, ion current which occurs in space A2 is also smoothly exhausted from the above-mentioned air-exhaustion aperture 143 so that electrical potential is provided. In such cases, since the end of side portion 142 which forms space A2 is provided brought into close contact with the surface of photoreceptor 101, external air does not enter in from the end of side portion 142 due to exhaustion effect. Accordingly, entrance of dust and spattered developer can be prevented so that the above-mentioned dust and spattered developer do not adhere on the edge of saw-toothed-shaped discharging points 111*a*. Saw-toothed-shaped discharging points 111*a* bears using for a long period. In addition, adverse influence cannot be given to the CEL (excess charge neutralizer).

Figure 21:
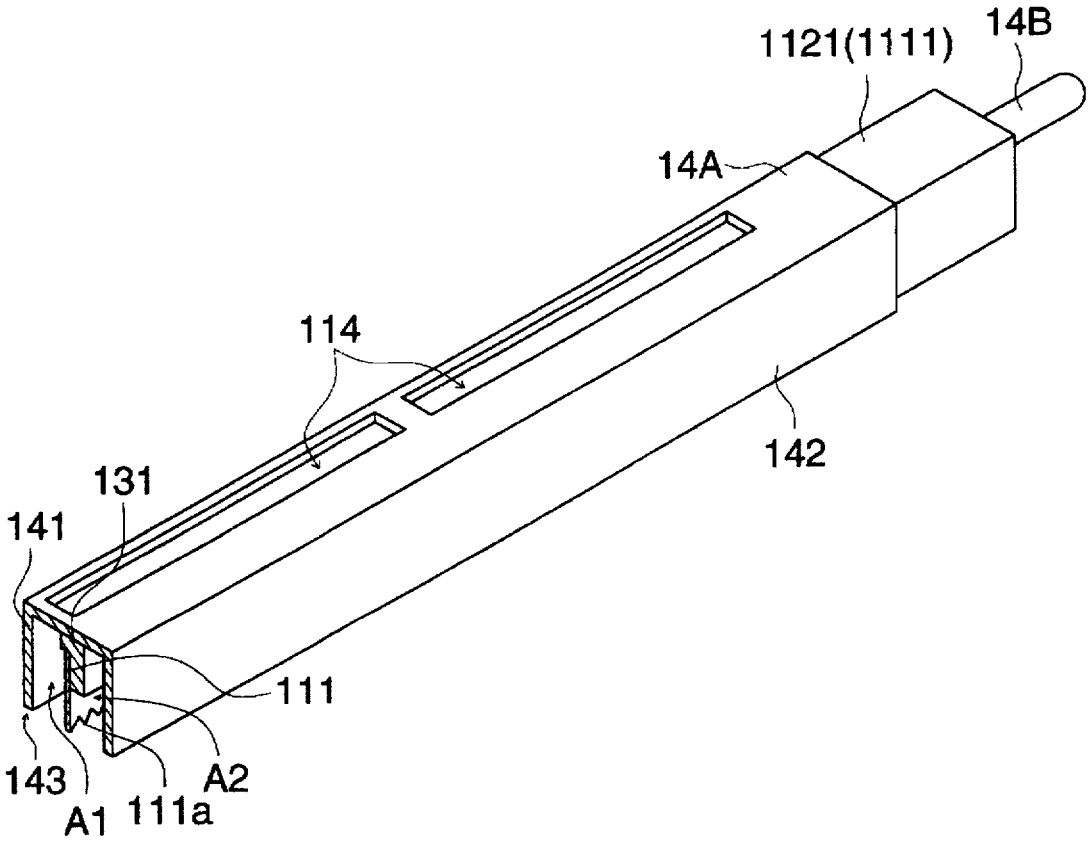
FIG. 21 is a side cross sectional showing a corona charger in FIG. 20 of the present invention.

FIG. 21 is a perspective view of corona charger 11 in the above FIG. 20 wherein a part thereof is cut out, showing slit 114 formed on the above-mentioned shield case base 14 which forms a ⊃-shaped in its cross section. At one end of side portions 141 and 142 formed integrally with aforesaid shielding case base 14A, insulating shielding case supporting members 1111 and 1121 are fixed to be supported. On shielding case supporting member 1121, connection terminal 14B is provided so that the above-mentioned plate-shaped electrode 13 and a high voltage portion are connected.

Figure 22:
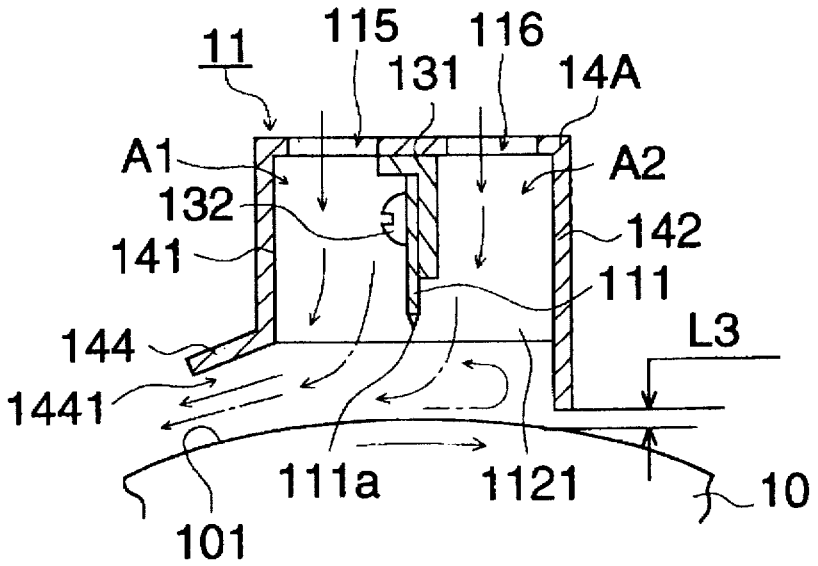
FIGS. 22(*a*) and 22(*b*) are side cross sectionals showing another corona charger of the present invention.
Figure 22:
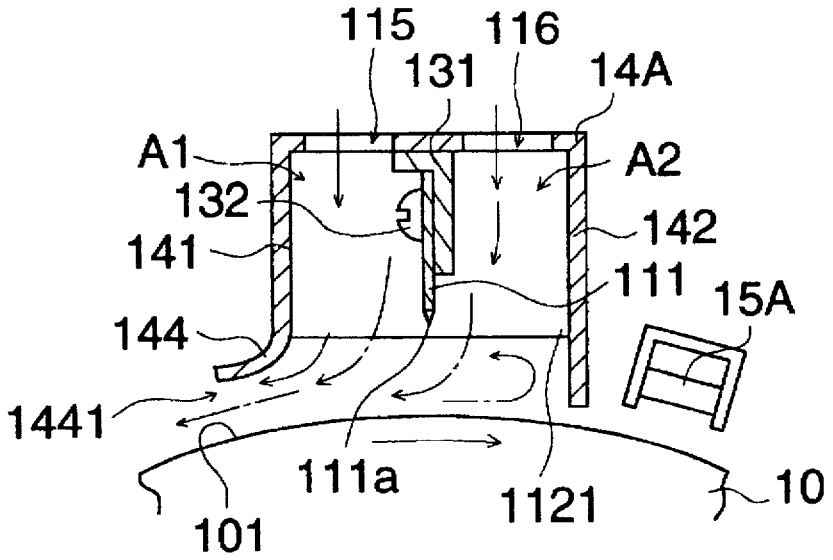

FIGS. 22(*a*) and 22(*b*) shows the seventh embodiment of corona charger 11 in the present invention.

In FIG. 22(*a*), plate-shaped electrode 111 which charges the above-mentioned photoreceptor 101 wherein saw-toothed-shaped discharging points 1112 is formed is composed of stainless steel plate having 0.1 mm thickness. Aforesaid plate-shaped electrode 111 is processed with etching, and forms numerous saw-toothed-shaped discharging points 111*a* on the side fringe facing image region on photoreceptor 101 on photoreceptor 10, which is a discharged body, and is installed facing with a prescribed clearance with the surface of photoreceptor 101.

In addition, shielding case 14 of corona charger 11 is composed of shielding case base 14A and side portions 141 and 142 formed integrally with aforesaid shielding case base 14A, forming metallic frame with channel-shaped cross section. Inside the above-mentioned shielding case base 14A, at approximately the center thereof, one end of supporting member 131 composed of L-shaped insulating material is fixed. As the fixing method, an adhesive material is used. At a part of supporting member 131, the above-mentioned plate-shaped electrode 111 is fixed at a prescribed position with supporting screw 132, and the above-mentioned saw-toothed-shaped discharging points 1112 is fixed at an adjusted and prescribed position. One end of the above-mentioned side portion 141 has a slight clearance with the surface of photoreceptor 101, and aforesaid end integrally forms air-exhaustion guide plate 144 toward exterior direction. Between aforesaid air-exhaustion guide plate 144 and the surface of photoreceptor 101, exhaustion aperture 1441 is formed.

Due to the structuring above, spaces A1 and A2 are separately formed inside side portions 141 and 142 formed integrally with the above-mentioned shielding case base 14A.

The above-mentioned shielding case base corresponding to the above-mentioned space A1, is provided with slit 115. The above-mentioned shielding case base 14A, corresponding to the above-mentioned space A2, is provided with slit 116.

FIG. 22(*b*) has the same constitution as FIG. 22(*a*), wherein one end of the above-mentioned side portion 141 has a slight clearance with the surface of photoreceptor 101, and aforesaid end integrally forms air-exhaustion guide plate 144 toward exterior direction. In the present embodiment, in order to make smooth exhaustion of air, i.e., in order to make smooth exhaustion of air from exhaustion aperture 1441, the above-mentioned air-exhaustion guide plate is curved toward outside.

As the above-mentioned FIGS. 22(*a*) and (*b*), when discharging is started in dashed line arrowed direction from saw-toothed discharging points 111*a* to photoreceptor 101, due to the ion current (shown by dashed arrowed lines) which occurs due to aforesaid discharging, exterior air is drawn from the above-mentioned slit 115 as shown by continuous arrowed lines so that the occurrence of the ion current is assisted and concurrently with this, air is smoothly expelled to outside through the above-mentioned air-exhaustion aperture 1441 due to the presence of air-exhaustion guide plate 144 formed on one end of the above-mentioned side portion 141. Accordingly, ion current additionally occurs so that charging efficiency is increased. Accordingly, in space A1, a prescribed potential can be provided on the surface of photoreceptor 101. In addition, charge is provided onto the surface of photoreceptor 101 due to discharging from the above-mentioned saw-toothed shaped discharging points 12. Exterior air is drawn into space A2 through slit 116 as shown by continuous arrowed lines. The ion current further occurs through aforesaid slit 116 as shown by dashed arrowed line so that potential is surely provided onto photoreceptor 101. In the above-mentioned manner, a prescribed potential is stably provided while corona charger 11 passes photoreceptor 101.

As is in the same manner as in the above-mentioned FIG. 20, in the present embodiment, since the end of side portion 142 which forms space A2 is provided brought into closely contact with the surface of photoreceptor 101, external air does not enter in from the end of side portion 142 due to exhaustion effect. Accordingly, entrance of dust and spattered developer can be prevented so that the above-mentioned dust and spattered developer do not adhere on the edge of saw-toothed-shaped discharging points 111*a*. Saw-toothed-shaped discharging points 111*a* bears using for a long period. In addition, adverse influence cannot be given to the CEL (excess charge neutralizer).

Figure 23:
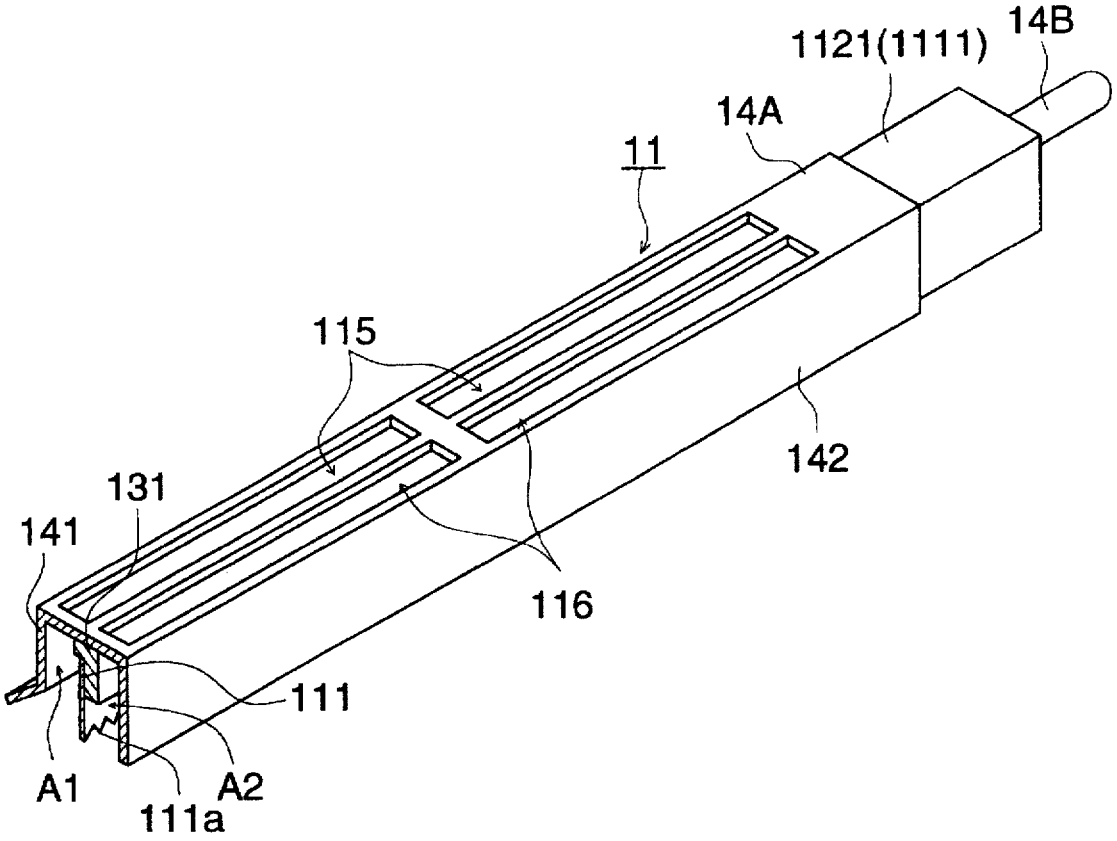
FIG. 23 is a side cross sectional showing a corona charger in FIG. 22 of the present invention.

FIG. 23 is a perspective view of corona charger 11 in the above-FIGS. 22(*a*) and (*b*) wherein a part thereof is cut out, showing slit 115 and 116 formed on the above-mentioned shield case base 14A which forms a ⊃-shaped in its cross sectional. At one end of side portions 141 and 142 formed integrally with aforesaid shielding case base 14A, insulating shielding case supporting member 1111 and 1121 is fixed to be supported. On shielding case supporting member 1121, connection terminal 14B is provided so that the above-mentioned plate-shaped electrode 13 and a high voltage portion are connected.

Figure 24:
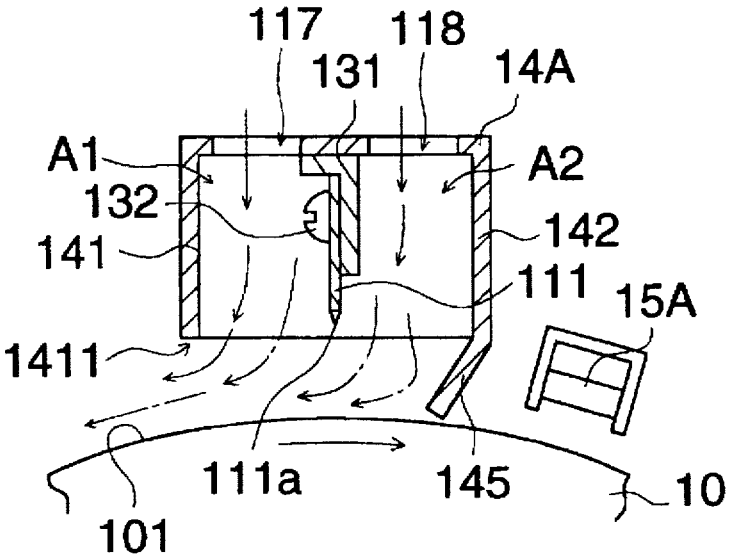
FIGS. 24(*a*) and 24(*b*) are side cross sectionals showing another corona charger of the present invention.
Figure 24:
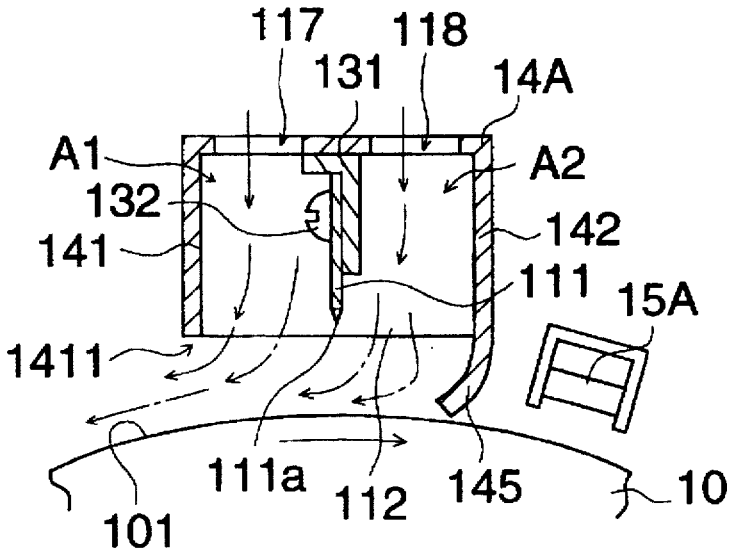

FIGS. 24(*a*) and 24(*b*) shows the seventh embodiment of corona charger 11 in the present invention.

In FIG. 24(*a*), plate-shaped electrode 111 which charges the above-mentioned photoreceptor 101 wherein saw-toothed-shaped discharging points 111*a* is formed is composed of stainless steel plate having 0.1 mm thickness. Aforesaid plate-shaped electrode 111 is processed with etching, and forms numerous saw-toothed-shaped discharging points 12 on the side fringe facing image region on photoreceptor 101 on photoreceptor 10, which is a discharged body, and is installed facing with a prescribed clearance with the surface of photoreceptor 101.

In addition, shielding case 14 of corona charger 11 is composed of shielding case base 14A and side portions 141 and 142 formed integrally with aforesaid shielding case base 14A, forming metallic frame with channel-shaped cross sectional. Inside the above-mentioned shielding case base 14A, at approximately the center thereof, one end of supporting member 131 composed of L-shaped insulating material is fixed. As the fixing method, an adhesive material is used. At a part of supporting member 131, the above-mentioned plate-shaped electrode 13 is fixed at a prescribed position with supporting screw 132, and the above-mentioned saw-toothed-shaped discharging points 1112 is fixed at an adjusted and prescribed position. End of the above-mentioned side portion 141 is separated from the surface of the above-mentioned photoreceptor 101 so that air-exhaustion aperture 1411 is formed. Concurrently with this, a part of the end of the above-mentioned side portion 142 is folded inward for forming exhaustion guide plate 145, and the edge of aforesaid exhaustion guide plate 145 is arranged to be brought into closely contact with the surface of photoreceptor 101. Due to the structuring as above, inside side portions 141 and 142 formed integrally with the above-mentioned shielding case base 14A, spaces A1 and A2 are separately formed.

The above-mentioned shielding case base 14A, corresponding to the above-mentioned space A1, is provided with slit 117. The above-mentioned shielding case base 14A, corresponding to the above-mentioned space A2, is provided with slit 118.

FIG. 24(*b*) has the same constitution as FIG. 24(*a*), wherein one end of the above-mentioned side portion 142 has in close contact with the surface of photoreceptor 101, and aforesaid end integrally forms air-exhaustion guide plate 145 toward interior direction. In the present embodiment, in order to make smooth exhaustion of air, the above-mentioned air-exhaustion guide plate is curved toward the inside.

As mentioned above, when discharging is started in dashed line arrowed direction from saw-toothed discharging points 111*a* in corona charger 11 as constituted above to photoreceptor 101, due to the ion current (shown by dashed arrowed lines) which occurs due to aforesaid discharging, exterior air is drawn from the above-mentioned slit 117 as shown by continuous arrowed lines so that the occurrence of the ion current is assisted and concurrently with this, due to that air is smoothly expelled to outside through the above-mentioned air-exhaustion aperture 1411 formed between the end of side portion 141 and the surface of photoreceptor 101. Accordingly, ion current favorably occurs so that a prescribed potential can be provided on the surface of photoreceptor 101. Further, due to ion current caused by discharging by saw-toothed discharging points 111*a*, external air is drawn as shown by continuous arrowed line through slit 118. The ion current shown by dashed arrowed line is guided by air-exhaustion guide plate 145 folded toward inside, and then exhausted smoothly by air-exhaustion unit 1411 of the above-mentioned side portion 141. Accordingly, due to the occurrence of the ion current, charging efficiency is further increased. In the above-mentioned manner, the surface of photoreceptor 101 is provided with a prescribed charge in space A1. In addition, charge is provided onto the surface of photoreceptor 101 due to discharging from the above-mentioned saw-toothed shaped discharging points 1112. Exterior air is drawn into space A2 through slit 118 as shown by continuous arrowed lines. The ion current further occurs through aforesaid slit 118 as shown by dashed arrowed line so that potential is surely provided onto photoreceptor 101. In the above-mentioned manner, a prescribed potential is stably provided while corona charger 11 passes photoreceptor 101.

As is in the same manner as in the above-mentioned FIG. 20, in the present embodiment, since the end of side portion 142 which forms space A2 is provided brought into close contact with the surface of photoreceptor 101, external air does not enter in from the end of side portion 142 due to exhaustion effect. Accordingly, entrance of dust and spattered developer can be prevented so that the above-mentioned dust and spattered developer do not adhere on the edge of saw-toothed-shaped discharging points 111*a*. Saw-toothed-shaped discharging points 111*a* bears using for a long period. In addition, adverse influence cannot be given to the CEL (excess charge neutralizer).

Figure 25:
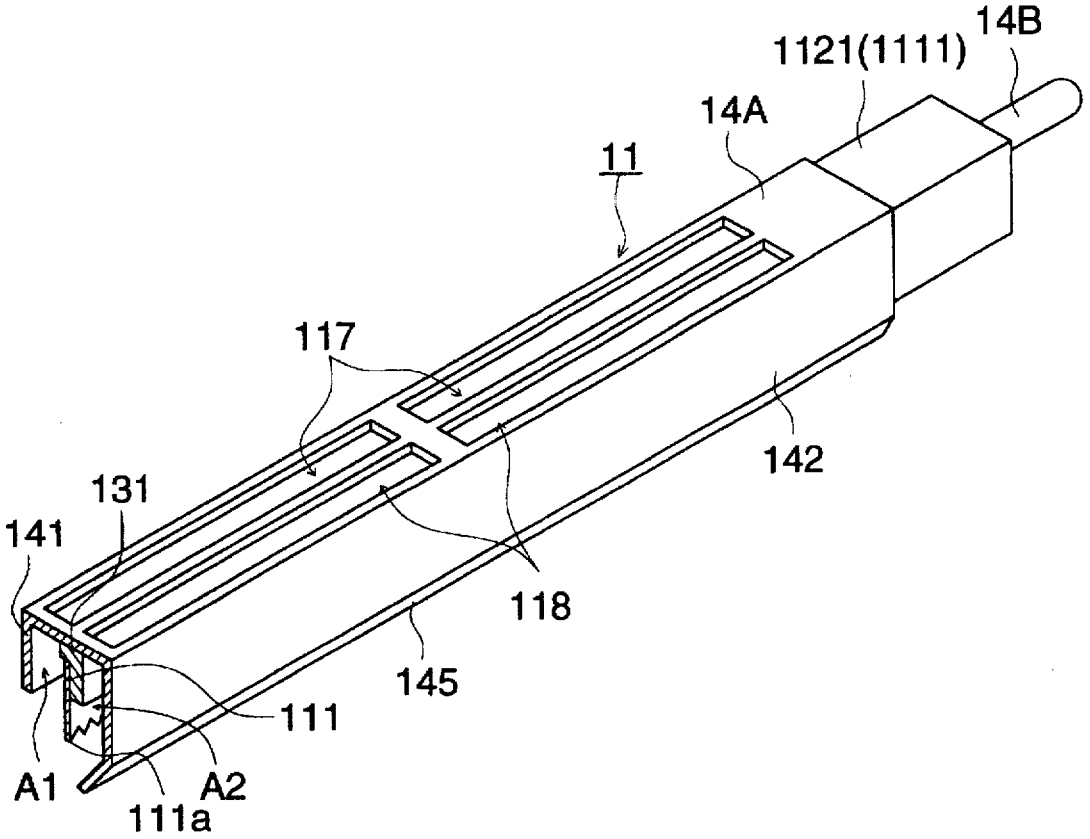
FIG. 25 is a side cross sectional showing a corona charger in FIG. 24 of the present invention.

FIG. 25 is a perspective view of corona charger 11 in the above FIGS. 24(*a*) and (*b*) wherein a part thereof is cut out, showing slits 117 and 118 formed on the above-mentioned shield case base 14A which forms a ⊐-shaped in its cross section. At one end of side portions 141 and 142 formed integrally with aforesaid shielding case base 14A, insulating shielding case supporting members 1111 and 1121 are fixed to be supported. On shielding case supporting member 1121, connection terminal 14B is provided so that the above-mentioned plate-shaped electrode 111 and a high voltage portion are connected.

Figure 26:
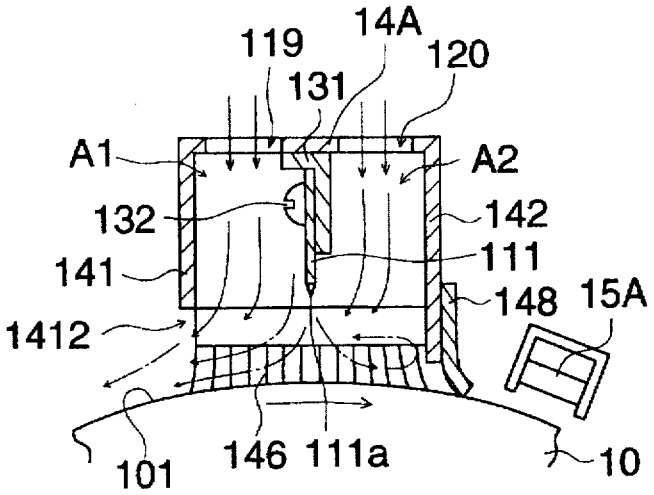
FIGS. 26(*a*) and 26(*b*) are a side cross sectional and a perspective view showing another corona charger of the present invention.
Figure 26:
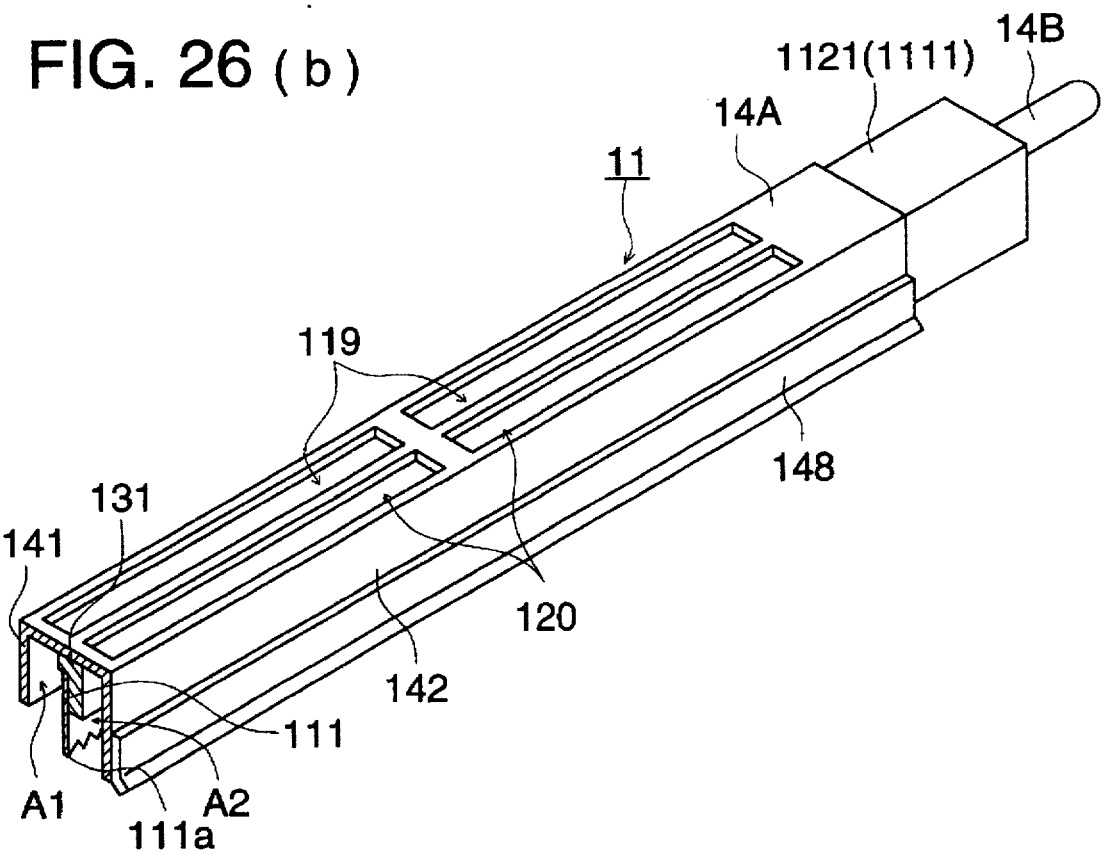

FIGS. 26(*a*) and 26(*b*) shows the nineth embodiment of corona charger 11 in the present invention.

In FIG. 26(*a*), plate-shaped electrode 111 which charges the above-mentioned photoreceptor 101 wherein saw-toothed-shaped discharging points 111*a* is formed is composed of stainless steel plate having 0.1 mm thickness. Aforesaid plate-shaped electrode 111 is processed with etching, and forms numerous saw-toothed-shaped discharging points 1112 on the side fringe facing image region on photoreceptor 101 on photoreceptor drum 10, which is a discharged body, and is installed facing with a prescribed clearance with the surface of photoreceptor 101.

In addition, the shielding case of the corona charger is composed of shielding case base 14A and side portion 141 and 142 formed integrally with aforesaid shielding case base 14A, forming metallic frame with channel-shaped cross sectional. Inside the above-mentioned shielding case base 14A, at approximately the center thereof, one end of supporting member 131 composed of L-shaped insulating material is fixed. As the fixing method, an adhesive material is used. At a part of supporting member 131, the above-mentioned plate-shaped electrode 111 is fixed at a prescribed position with supporting screw 132, and the above-mentioned saw-toothed-shaped discharging points 1112 is fixed at an adjusted and prescribed position. Between the end of the above-mentioned side portion 141 and the surface of the above-mentioned photoreceptor 101, air-exhaustion aperture 1412 is formed. Concurrently with this, at the end of the above-mentioned side portion 142, elastic sealing member 148, which is an elastic shielding member, wherein one end is adhered on aforesaid side portion 142 to be fixed and the other end of constantly brought into contact with the surface of photoreceptor 101. Practically, for the above-mentioned elastic sealing member 148, urethane rubber having no influence on latent images formed on photoreceptor 101 is used.

Figure 27:
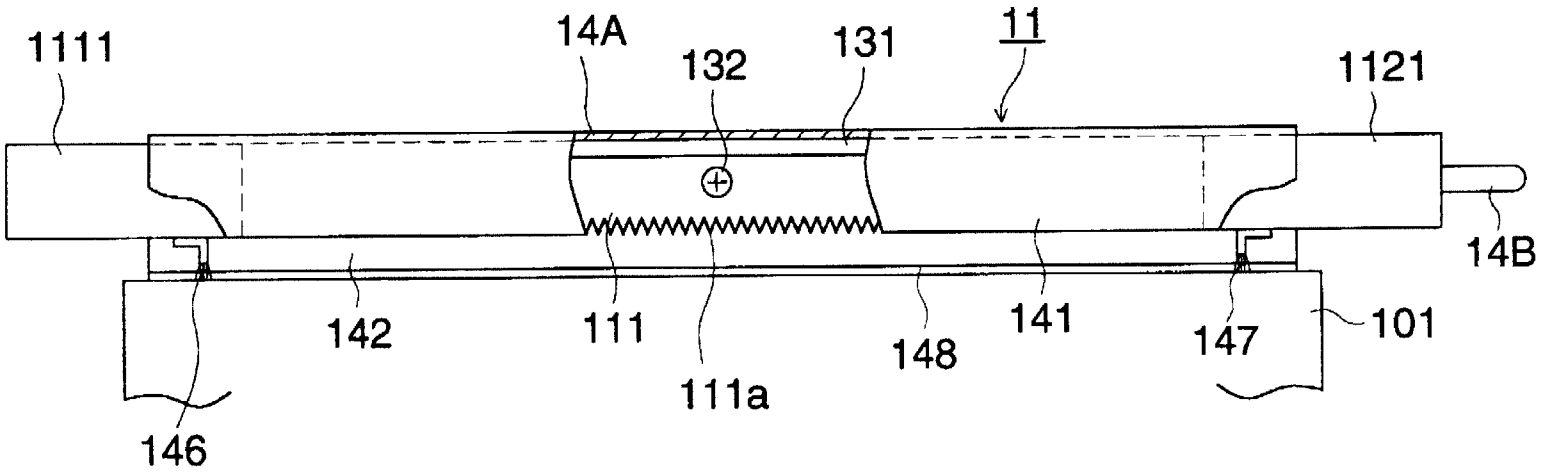
FIG. 27 is a side cross sectional showing a corona charger in FIG. 26 of the present invention.

As shown in FIG. 27, at the end of the above-mentioned shielding case base 14A and the shielding case formed by ⊐-shaped with side portion 141 and 142 are fixed to be maintained. As shown in FIG. 27, brush-edged protection members 146 and 147 wherein one end thereof is fixed to aforesaid shielding case supporting members 1111 and 1121, and the other end is brought into contact with the surface of photoreceptor 101.

Due to the structuring as above, inside side portions 141 and 142 integrally formed with the above-mentioned shield case base 14A, space A1 and A2 are respectively formed.

The above-mentioned shielding case base 14A, corresponding to the above-mentioned space A1, is provided with slit 119. The above-mentioned shielding case base 14A, corresponding to the above-mentioned space A2, is provided with slit 120.

FIG. 26(*b*) is a perspective view of corona charger 11 in the above-FIGS. 26 and 27 wherein a part thereof is cut out, showing slits 119 and 120 formed on the above-mentioned shield case base 14A which forms a ⊐-shaped in its cross sectional. At one end of side portions 141 and 142 formed integrally with aforesaid shielding case base 14A, insulating shielding case supporting member 1111 and 1121 is fixed to be supported. On shielding case supporting member 1121, connection terminal 14B is provided so that the above-mentioned plate-shaped electrode 111 and a high voltage portion are connected. In addition, elastic sealing member 148 fixed on the above-mentioned side portion 142 is provided on entire end of side portion 142, as shown in FIG. 26(*b*).

As the mentioned above, when discharging is started in dashed line arrowed direction from saw-toothed discharging points 111*a* in corona charger 11 as constituted above to photoreceptor 101, due to the ion current (shown by dashed arrowed lines) which occurs due to aforesaid discharging, exterior air is drawn from the above-mentioned slit 119 as shown by continuous arrowed lines to space A1 so that the occurrence of the ion current is assisted and concurrently with this, due to that air is smoothly expelled to outside since a prescribed clearance is formed between the end of side portion 141 and the surface of photoreceptor 101. Accordingly, ion current favorably occurs so that a prescribed potential can be provided on the surface of photoreceptor 101. Further, due to ion current caused by discharging by saw-toothed discharging points 111*a*, external air is drawn as shown by continuous arrowed line through slit 120. The ion current shown by dashed arrowed line is smoothly exhausted from air-exhaustion aperture 1412 formed between one end of the above-mentioned side portion 141 and the surface of photoreceptor 101, employing elastic sealing member 148 provided on the above-mentioned side portion 142 and brush-edged shielding member 146 and 147 wherein one end is fixed to shielding case supporting members 1111 and 1121 and the other end is brought into contact with the surface of photoreceptor 101. Accordingly, more favorable ion current flow can be obtained.

Exterior air is drawn into space A2 through slit 118 as shown by continuous arrowed lines. The ion current further occurs through aforesaid slit 118 as shown by dashed arrowed line so that potential is surely provided onto photoreceptor 101. In the above-mentioned manner, a prescribed potential is stably provided while corona charger 11 passes photoreceptor 101.

Air does not enter through side portion 141 and 142 due to elastic sealing member 148 and brush-edged protection members 146 and 147 as described above. Accordingly, entrance of dust and spattered developer can be prevented so that the above-mentioned dust and spattered developer do not adhere on the edge of saw-toothed-shaped discharging points 111*a*. Saw-toothed-shaped discharging points 111*a* bears using for a long period. In addition, adverse influence cannot be given to the CEL (excess charge neutralizer).

In the fifth embodiment of the present invention, on upstream side and downstream side compared to the above-mentioned plate-shaped electrode provided in the above-mentioned metallic body, plural apertures were provided, which were formed for inhaling outside air from the above-mentioned metallic body. With regard to plural apertures, the width of the above-mentioned upstream side is larger than that of the downstream aperture. Accordingly, on upstream side of the former half of charging, ion current flows favorably. Therefore, specifically in half-tone image, uniformity of charge potential is obtained. In addition, the plate-shaped electrode is difficult to be influenced from dust such as a developer. Accordingly, aforesaid plate-shaped electrode can bear using for a long period.

The above-mentioned plural apertures were formed on the base on the above-mentioned body. Accordingly, the flow of ion current was specifically favorable.

Since a reinforcing rib was formed on plural apertures formed on the base of the above-mentioned metallic body and, in addition, numerous ribs formed on the aperture on the above-mentioned downstream side, the ion current favorably flows on the upstream side of the charging latter half. Accordingly, uniform charging potential can be obtained, specifically in half tone image. In addition, the plate-shaped electrode is difficult to received influence from dust such as a developer, it can bear using for a long time.

In the sixth embodiment, an aperture portion formed for inhaling exterior air from the above-mentioned metallic body was provided on the upstream side of the above-mentioned plate-shaped electrode installed inside the above-mentioned metallic body and an air-exhaustion aperture portion was also formed on one side of side portion positioned on the upstream side of the above-mentioned metallic body, and it was so structured that one end of side portion position on the above-mentioned downstream side of the above-mentioned metallic body was brought into contact with the above-mentioned discharged surface. Since the ion current which occurred by the plate-shaped electrode is not interfered on the upstream side, stable charge potential can be obtained for the photoreceptor. Since uneven discharge can be prevented, space between a side portion and the photoreceptor substantially forms an air-exhaustion portion. Therefore, toner spattered from the development unit or the cleaning device does not enter so that dirt on the plate-shaped electrode is minimized. Accordingly, the charger can bear using for a long time.

The above-mentioned aperture provided on the upstream side of the above-mentioned plate-shaped electrode was formed on the base on the above-mentioned body. Accordingly, the flow of ion current, specifically on the upstream side, was specifically favorable. Therefore, stable charge potential can be obtained for the photoreceptor.

Since the air-exhaustion portion provided on one end of the side portion of the above-mentioned metallic body is provided between the above-mentioned side portion and the above-mentioned discharged body, stable charge potential can be obtained for the photoreceptor. Since uneven discharge can be prevented, space between a side portion and the photoreceptor substantially forms an air-exhaustion portion. Therefore, toner spattered from the development unit or the cleaning device does not enter so that dirt on the plate-shaped electrode is minimized. Accordingly, the charger can bear using for a long time.

In the seventh embodiment, plural apertures formed for inhaling air exterior from the above-mentioned metallic body and an exhaustion guide means wherein an air-exhaustion aperture was formed on the one end of a side plate positioned on the above-mentioned upstream side of the above-mentioned metallic body were provided at both ends of the upstream side and the downstream side of the above-mentioned plate-shaped electrode provided inside the above-mentioned metallic body, and it was so structured that one end of the side portion positioning at the above-mentioned downstream side of the above-mentioned metallic body, the ion current which occurred from the plate-shaped electrode was not interfered on the upstream side. Accordingly, stable charge potential can be obtained for the photoreceptor. Since uneven discharge can be prevented, space between a side portion and the photoreceptor substantially forms an air-exhaustion portion. Therefore, toner spattered from the development unit or the cleaning device does not enter so that dirt on the plate-shaped electrode is minimized. Accordingly, the charger can bear using for a long time.

The above-mentioned plural apertures are formed on the base of the above-mentioned metallic body, and concurrently with this, the exhaustion guide means wherein the above-mentioned air-exhaustion apertures were formed is provided toward outside from the above-mentioned side portion and formed between the side portion of the above-mentioned metallic body and the above-mentioned discharged body, leakage of light from PCL (pre-charging neutralizer) on the charging region on the photoreceptor can be prevented so that favorable image can be obtained.

In the eighth embodiment, plural apertures formed for inhaling air from exterior of the above-mentioned metallic body and an air-exhaustion aperture formed on the one end of a side plate positioned on the above-mentioned upstream side of the above-mentioned metallic body were provided at both ends of the upstream side and the downstream side of the above-mentioned plate-shaped electrode provided inside the above-mentioned metallic body, and it was so structured that one end of the side portion positioning at the above-mentioned downstream side of the above-mentioned metallic body, and an exhaustion guide means formed toward the above-mentioned upstream side were formed and the ion current which occurred from the plate-shaped electrode was not interfered on the upstream side. Accordingly, stable charge potential can be obtained for the photoreceptor. Since uneven discharge can be prevented, space between a side portion and the photoreceptor substantially forms an air-exhaustion portion. Therefore, toner spattered from the development unit or the cleaning device does not enter so that dirt on the plate-shaped electrode is minimized. Accordingly, the charger can bear using for a long time. Concurrently with this, since the above-mentioned exhaustion guide means is curved inside, when a small-sized photoreceptor drum is provided, it is advantageous for providing process members in terms of designing.

Due to a structure that the plural apertures are formed on the base of the above-mentioned metallic body and that the exhaustion aperture formed on the above-mentioned side portion is formed between the above-mentioned side portion and the above-mentioned discharged body, the ion current which occurred from the plate-shaped electrode was not interfered on the upstream side. Accordingly, stable charge potential can be obtained for the photoreceptor.

In the nineth embodiment, due to providing plural aperture formed for inhaling air from outside of the above-mentioned metallic body, an exhaustion aperture provided on one end of side portion positioning on the above-mentioned upstream side of the above-mentioned metallic body and the elastic shielding member, provided on the side portion positioning on the above-mentioned downstream side of the above-mentioned metallic body, which is brought into contact with the above-mentioned discharged body at the positions of both end on the upstream side and the downstream side of the above-mentioned plate-shaped electrode provided on the above-mentioned metallic body, the ion current which occurred from the plate-shaped electrode was not interfered on the upstream side. Accordingly, stable charge potential can be obtained for the photoreceptor. Since there is no occurrence of uneven discharging and exhaustion aperture on the side end becomes substantially an exhaustion port, inhalation of dust and toner spattering from the developing unit and the cleaning device can be prevented so that contamination of the plate-shaped electrode can be prevented. Accordingly, favorable charging effect can be obtained for a long time.

Due to a structure that the above-mentioned plural apertures are formed on the above-mentioned base and that the exhaustion aperture formed on the above-mentioned side portion is formed between the above-mentioned side portion and the above-mentioned discharged body, the ion current which occurred from the plate-shaped electrode was not interfered on the upstream side. Accordingly, stable charge potential can be obtained for the photoreceptor.

Due to providing an elastic shielding member, provided on the side portion positioning on the above-mentioned downstream side of the above-mentioned metallic body, which is brought into contact with the above-mentioned discharged body, both-end apertures on the above-mentioned metallic body and brush-edged shielding members between the side portion of the above-mentioned metallic body and the above-mentioned discharged body, inhalation of dust and toner spattering from the developing unit and the cleaning device can be prevented so that contamination of the plate-shaped electrode can be prevented. Accordingly, favorable charging effect can be obtained for a long time.

What is claimed is:

1. An apparatus for charging a photoreceptor which moves in a predetermined moving direction comprising:

a housing having, at a charging side, a first opening adapted to face said photoreceptor;

an electrode charging member in said housing including a plurality of sharp-edged electrodes aligned in a direction perpendicular to said moving direction of said photoreceptor;

said electrode charging member adapted to receive an electric voltage from a power source and to apply the electric voltage to the plurality of sharp edged electrodes so that said photoreceptor is charged through a first opening at said charging side by corona discharge from the plurality of sharp edged electrodes;

an air introducing device at a rear side of said housing, opposite said charging side, for introducing air into said housing, wherein said air introducing device comprises a second opening at said rear side, wherein said second opening is divided into an upstream opening, positioned upstream of said electrode charging member in terms of said moving direction, and a downstream opening, an opening area of the downstream opening being smaller than that of said upstream opening.

2. The apparatus of claim 1, wherein the upstream opening and the downstream opening are shaped in a form of a slit provided with a reinforcing rib, and wherein a number of reinforcing ribs provided to the downstream opening is more than that provided to the upstream opening.

3. An apparatus for charging a photoreceptor which moves in a predetermined moving direction comprising:

a housing having, at a charging side, a first opening adapted to face said photoreceptor;

an electrode charging member in said housing including a plurality of sharp-edged electrodes aligned in a direction perpendicular to said moving direction of said photoreceptor;

said electrode charging member adapted to receive an electric voltage from a power source and to apply the electric voltage to the plurality of sharp edged electrodes so that said photoreceptor is charged through a first opening at said charging side by corona discharge from the plurality of sharp edged electrodes;

an air introducing device at a rear side of said housing, opposite said charging side, for introducing air into the housing, wherein said air introducing device comprises a second opening at said rear side, wherein said second opening is upstream of said electrode charging member in terms of said moving direction, an upstream side wall of said housing having an exhaust opening, and a downstream side wall of said housing extended so as to be adjacent said photoreceptor.

4. The apparatus of claim 3, wherein the exhaust opening is positioned between the upstream side wall and the photoreceptor.

5. An apparatus for charging a photoreceptor which moves in a predetermined moving direction comprising:

a housing having, at a charging side, a first opening adapted to face said photoreceptor;

an electrode charging member in said housing including a plurality of sharp-edged electrodes aligned in a direction perpendicular to said moving direction of said photoreceptor;

said electrode charging member adapted to receive an electric voltage from a power source and to apply the electric voltage to the plurality of sharp edged electrodes so that said photoreceptor is charged through a first opening at said charging side by corona discharge from the plurality of sharp edged electrodes;

an air introducing device at a rear side of said housing, opposite said charging side, for introducing air into said housing, wherein said air introducing device comprises a second opening at said rear side, wherein said second opening is divided into a first opening upstream of said electrode charging member in terms of said moving direction, and a downstream opening, an upstream side wall of said housing having an exhaust opening, and a downstream side wall of said housing being extended so as to be adjacent said photoreceptor.

6. An apparatus for charging a photoreceptor which moves in a predetermined moving direction, comprising:

a housing having, at a charging side, a first opening adapted to face said photoreceptor and a rear plate, at a rear side of said housing, opposite to said charging side, said rear plate enclosing said rear side;

an electrode charging member in said housing, said member including a partition plate perpendicular to said moving direction, one end of said partition plate being fixed to said rear plate thereby dividing said rear side into two compartments;

a plurality of sharp-edged electrodes aligned in a direction perpendicular to said moving direction at another end of said partition plate, whereby said electrode charging member is adapted to receive an electric voltage from a power source and to apply said electric voltage to said plurality of sharp edged electrodes thereby charging said photoreceptor through said first opening by corona discharge; and said rear plate having a first opening upstream of said partition plate and a downstream opening, whereby air is introduced from said upstream opening and said downstream opening into each compartment of said housing to create air flows on both sides of said sharp-edged electrodes.

7. The apparatus of claim 6, wherein the downstream side wall is provided with a guide member for guiding air so as to be discharged from the exhaust opening.

8. The apparatus of claim 6, wherein the downstream side wall is provided with a elastic shielding member adapted to come in contact with the photoreceptor.

9. The apparatus of claim 6, wherein both end walls are provided with a brush-shaped shielding member adapted to come in contact with the photoreceptor.

10. The apparatus of claim 6 wherein said partition plate comprises an insulated base plate and an electrode plate.

11. The apparatus of claim 6 wherein the sharp edged electrodes are shaped in one of a needle and saw teeth.

12. The apparatus of claim 6 wherein the upstream opening and the downstream opening are one of a slit and a plurality of holes.

13. The apparatus of claim 6 wherein the upstream opening and the downstream opening are provided with a filter to prevent dust from entering into the housing.

14. The apparatus of claim 6 wherein the upstream opening and the downstream opening are extended longer than the aligned length of the plurality of sharp-edged electrodes.

15. The apparatus of claim 6 wherein on the rear plate are provided two guide plates for introducing air to the upstream opening and the downstream opening.

16. The apparatus of claim 15 wherein the distance between the two guide plates is larger than the width of the housing in terms of the moving direction of the photoreceptor.

17. The apparatus of claim 6 further comprising an air supply fan to supply air into the housing through the upstream opening and the downstream opening.

18. The apparatus of claim 6 further comprising an air exhaust fan to exhaust air from the housing so that air is introduced through the upstream opening and the downstream opening into the housing.

* * * * *